US006790368B1

(12) United States Patent
Vachon et al.

(10) Patent No.: US 6,790,368 B1
(45) Date of Patent: Sep. 14, 2004

(54) METHOD AND SYSTEM FOR THE RECUPERATION OF SEPTIC TANK CONTENT

(75) Inventors: Tony Vachon, St. Joseph-de-Beauce (CA); Erick Vachon, Joseph-de-Beauce (CA)

(73) Assignee: Groupe SNS (Service de nettoyage sanitaire) Inc. (CA)

( * ) Notice: Subject to any disclaimer, the term of this patent is extended or adjusted under 35 U.S.C. 154(b) by 0 days.

(21) Appl. No.: 10/049,365

(22) PCT Filed: Aug. 4, 2000

(86) PCT No.: PCT/CA00/00908

§ 371 (c)(1),
(2), (4) Date: Feb. 6, 2002

(87) PCT Pub. No.: WO01/11155

PCT Pub. Date: Feb. 15, 2001

(30) Foreign Application Priority Data

Aug. 6, 1999 (CA) ..... 2279697

(51) Int. Cl.[7] ..... C02F 9/00; B01D 21/00

(52) U.S. Cl. ..... 210/747; 210/803; 210/805; 210/170; 210/241; 210/416.1; 210/424; 210/532.2; 15/340.1

(58) Field of Search ..... 210/747, 803, 210/805, 806, 170, 241, 257.1, 258, 416.1, 418, 424, 433.1, 532.2; 15/340.1, 353

(56) References Cited

U.S. PATENT DOCUMENTS 2,638,224 A * 5/1953 Rupp ..... 210/241
3,262,571 A * 7/1966 Petretti ..... 210/241
4,134,174 A * 1/1979 Flynn et al. ..... 15/340.1
4,199,837 A * 4/1980 Fisco, Jr. ..... 15/340.1
4,322,868 A * 4/1982 Wurster ..... 15/340.1
4,389,314 A * 6/1983 Petretti ..... 210/241
4,525,277 A 6/1985 Poulin ..... 210/532.2
4,578,198 A * 3/1986 Schmidt et al. ..... 210/805
4,816,167 A * 3/1989 Vanderslice ..... 210/241
5,312,551 A * 5/1994 Perron et al. ..... 210/257.1
5,503,753 A * 4/1996 Woodall et al. ..... 210/803
5,536,418 A * 7/1996 Foss ..... 210/805
5,657,782 A * 8/1997 Berning
5,720,885 A * 2/1998 Moos ..... 210/747
5,946,767 A * 9/1999 Sinz ..... 15/340.1
6,379,547 B1 * 4/2002 Larsson ..... 210/176

FOREIGN PATENT DOCUMENTS

DE 4300709 7/1994

* cited by examiner

*Primary Examiner*—Christopher Upton
(74) *Attorney, Agent, or Firm*—Orum & Roth

(57) ABSTRACT

A method and system for the recuperation of the content of septic tank where the supernatant is returned to the septic tank after the recuperation of the sludge and of the scum is described herein. According to the method of the present invention, a major portion of the supernatant is advantageously recuperated from the top of the septic tank to the bottom thereof, and stored in a first reservoir of the system. The sludge, the remainder of the supernatant and the scum are then recuperated and stored in a second reservoir. The supernatant is filtered, either upon its recuperation or before its return to the septic tank. Finally, the filtered supernatant is returned to the septic tank.

29 Claims, 19 Drawing Sheets

METHOD AND SYSTEM FOR THE RECUPERATION OF SEPTIC TANK CONTENT

FIELD OF THE INVENTION

The present invention relates to the recuperation of septic tank content. More specifically, the present invention is concerned with a method and a system that enable the efficient recuperation of the sludge contained in septic tank.

BACKGROUND OF THE INVENTION

Owners of residences that are not connected to a conventional sewer system are often forced to comply with local regulation that requires them to install a septic tank.

So called, "Vacuum" type trucks were developed to literally suck up the sludge from the septic tank and then to dispose it in appropriate dumping sites. However, since the environmental norms have become more rigid in many countries, the management of sludge has become a problem that the governmental and municipal authorities have been trying to overcome. More specifically, means that would permit the reduction of these residual matters at the source, which would promote their reuse as well as valorise them, are being searched.

Still, today considering the costs generated by the dumping of sludge in the appropriate sites and time wasted in transporting the sludge, many contract workers employed to recuperate the content of septic tanks refuse to conform to the regulations, and therefore set up septic tanks almost everywhere in the environment. This, of course, can have unfortunate consequences.

Many technologies are currently available or known in this field. The following is a brief summary of these technologies.

Vacuum Type Truck

This is a system that uses a pump to empty the whole content of the septic tank. This system is generally well accepted by clients and operators, since no liquid is returned to the tank after the recuperation of the septic tank content is over. This system is the most widely used to this day. However, this system comprises several drawbacks. For example, since all of the content must be recuperated and transported to the dumping site, the operation of this system is very expensive in transport and handling costs when the dumping site/plant is situated at a far distance from the client.

Dehydration Type Truck

This is a system that uses a pump as well as a centrifuge unit to generate dryer sludge. The system requires the use of chemical products such as coagulants and/or floculants, and requires also a longer treatment time. Although this process yields the dehydration of the sludge at 90% of the volume to be transported, the sludge is generally not sufficiently dehydrated to be dumped directly in the dumping sites. In addition, the sludge is usually too thick to be poured in a treatment plant, which renders their disposition in appropriate sites difficult. This technology also requires a bulky and long mobile unit, which limits the access to the septic tank. Another drawback of such a system is that it is expensive since the dehydration demands a lot of time and expensive chemical products. The mobile unit is also difficult to operate, hence more qualified labour is necessary.

Double Chamber Vacuum Truck

Double chamber vacuum trucks include a pump that can return a portion of the liquid to the septic tank. The mobile unit sends back the water to the tank without having filtered it. The quantity of sludge to transport is therefore reduced since a portion of the liquid of the septic tank is returned to the tank after the sludge is removed. In addition, the process does not use chemical substances.

However, since no filtration is done before returning the liquid to the septic tank, there is no guarantee that the liquid that is returned does not contain sludge. There is no precise mechanism that indicates to the operator the quantity of sludge that has been retrieved or that has to be retrieved. Thus, the operator can only rely on his experience. Moreover, by returning the liquid that comprises suspended solid in the tank, it gives rise to a risk that, after an influx of water, the suspended solid will end up blocking the purification field. The consequences of such a block are significant, considering that a defective purification field should be reconstructed completely. Another important disadvantage is that the client is bound to a restrictive use of water 12 to 24 hours following the draining of the tank, in order to limit the possibly harmful water influx.

SUMMARY OF THE INVENTION

More specifically, in accordance with the present invention, there is provided a method for the recuperation of septic tank content using a mobile recuperation unit having first and second reservoirs, the content of the septic tank including sludge, supernatant and scum, the method comprising:

transferring a portion of the supernatant from the septic tank to the first reservoir of the mobile recuperation unit;

transferring the remainder of the content of the septic tank into the second reservoir of the mobile recuperation unit;

filtering the supernatant; and transferring the filtered supernatant from the first reservoir back to the septic tank.

According to another aspect of the present invention, there is provided a system for the recuperation of septic tank content including sludge, supernatant and scum, the system comprising:

a first reservoir;

a second reservoir;

a bidirectional pump assembly having at least one pump suction pipe having a proximate end connected to a first port thereof; the pump assembly having a second port connected to the first reservoir and a third port connected to the second reservoir;

a filtering assembly provided between the second port and the first reservoir;

whereby, the bidirectional pump assembly is so controlled as to pump the supernatant from the septic tank into the first reservoir, filter this supernatant via the filtering assembly, pump the sludge and the scum to the second reservoir and pump back the filtered supernatant to the septic tank to thereby reduce the portion of the content of the septic tank remaining in the recuperation system.

According to a third aspect of the present invention, there is provided a system for the recuperation of septic tank content including sludge, supernatant and scum, the system comprising:

a first reservoir;

a first pump having an inlet and an outlet open to the first reservoir;

a first pump suction pipe having a proximate end connected to the inlet of the first pump;

a filtering assembly associated with the first pump suction pipe;

a second reservoir;

a second pump having an inlet and an outlet open to the second reservoir;

a second pump suction pipe having a proximate end connected to the inlet of the second pump;

whereby, a) the first pump may be so controlled as to pump the supernatant from the septic tank to the first reservoir, b) the filtering assembly may be so controlled to filter the pumped supernatant, c) the second pump may be so controlled as to pump the sludge and the scum to the second reservoir, and d) the first pump may be so controlled as to pump back the filtered supernatant to the septic tank to thereby reduce the portion of the content of the septic tank remaining in the recuperation system.

According to yet another aspect of the present invention, there is provided a system for the recuperation of septic tank content including sludge, supernatant and scum, the system comprising:

a first reservoir;

a first pump suction pipe having a proximate end connected to the first reservoir;

a second reservoir;

a second pump suction pipe having a proximate end connected to the second reservoir;

a vacuum pump connected to the first and second reservoirs. a filtering assembly associated with the first reservoir;

whereby, a) the vacuum pump may be so controlled as to generate a partial vacuum in the first reservoir to pump the supernatant from the septic tank to the first reservoir, b) the filtering assembly may be so controlled to filter the pumped supernatant, c) the vacuum pump may be so controlled as to generate a partial vacuum in the second reservoir to pump the sludge and the scum to the second reservoir, and d) the filtered supernatant may be returned to the septic tank via the first pump suction pipe to thereby reduce the portion of the content of the septic tank remaining in the recuperation system.

According to a fifth aspect of the present invention, there is provided a system for the recuperation of septic tank content including sludge, supernatant and scum, the system comprising:

a first reservoir;

a second reservoir;

means for pumping the supernatant into the first reservoir and the sludge and scum into the first reservoir; the pumping means being configured to allow the pumping back of the supernatant into the septic tank;

means for filtering the supernatant;

whereby, the system is so controlled as to pump the supernatant from the septic tank into the first reservoir via the pumping means, filter this supernatant via the filtering means, pump the sludge and the scum to the second reservoir and pump back the filtered supernatant to the septic tank via the pumping means to thereby reduce the portion of the content of the septic tank remaining in the recuperation system.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

The present innovation helps to resolve the above-noted problems encountered by the present technologies by the elaboration of a method and a system, i.e., a mobile unit, for the recuperation of septic tanks content.

As will generally be understood upon reading the following description, the method and system of the present invention allow a considerable reduction of the costs involved in the recuperation of septic tank content while respecting the usual environmental norms.

As is commonly known, in a standard septic tank, the settable sludge deposits with time at the bottom thereof. Supernatant less contaminated is present at the surface of the sludge and scum is found at the surface of the supernatant.

In a nutshell, the present invention aims at removing the major portion of the supernatant while minimising the contamination thereof by the sludge and the scum. Once the sludge and the scum are removed from the septic tank, the filtered supernatant may be returned to the tank to thereby a) reduce the volume of the waste material to be transported to a disposal site, and b) reintroduce the natural microflora to the septic tank to thereby increase its efficiency.

Figures 1, 1A:
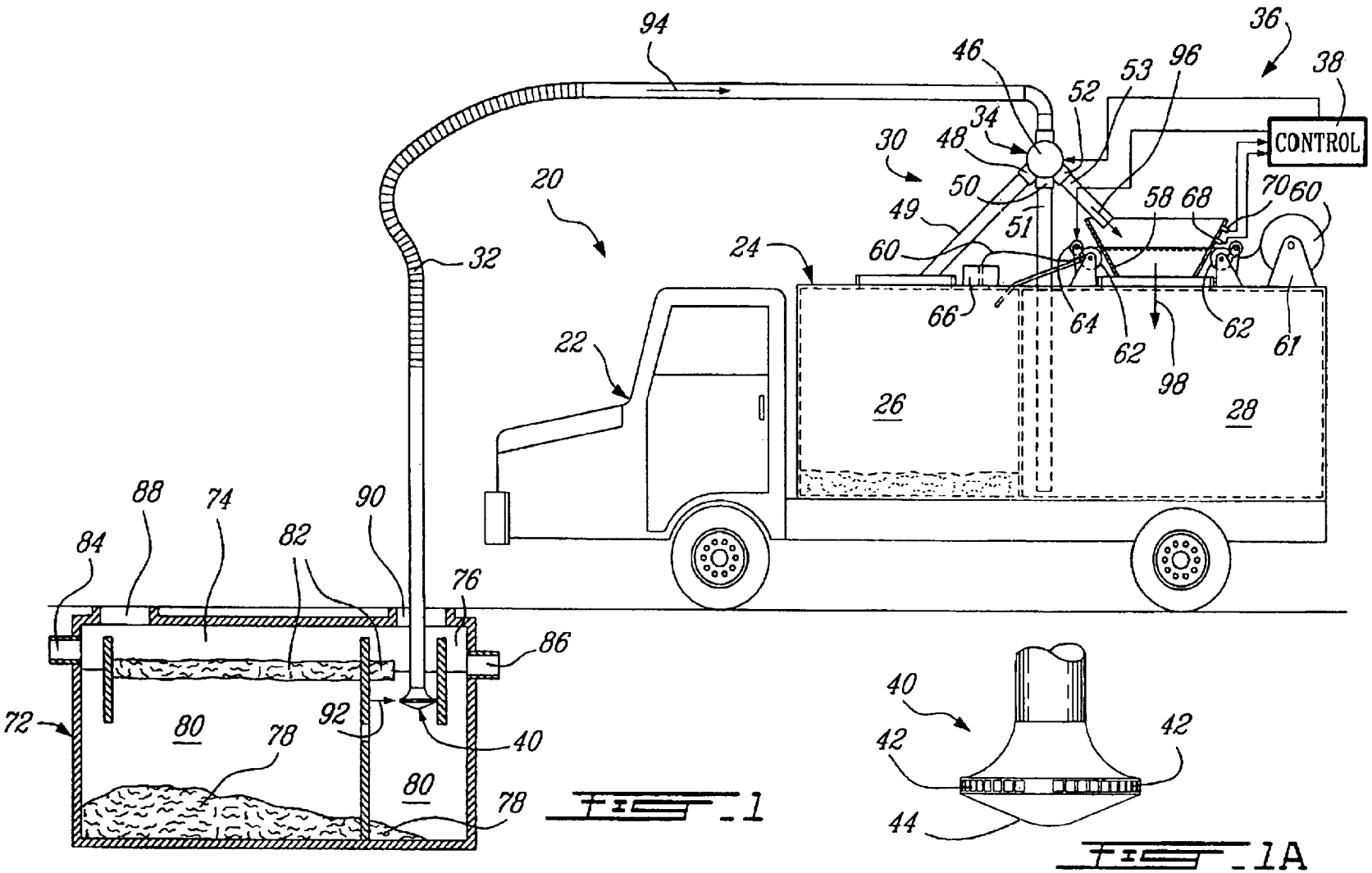
FIG. 1 is a schematic side elevational view of a mobile recuperation unit for the recuperation of septic tank content according to a first embodiment of the present invention.
FIG. 1A is a side elevational view of the nozzle of the mobile recuperation unit of FIG. 1.

Turning now to FIG. 1 of the appended drawings, a mobile recuperation unit 20 according to a first embodiment of the system of the present invention will be described.

The mobile recuperation unit 20 comprises a flatbed truck 22 and a sludge recuperation assembly 24 including a sludge reservoir 26, a supernatant reservoir 28 and a pumping sub-assembly 30.

Of course, since the flatbed truck 22 is mainly used to transport the sludge recuperation assembly 24 it could be replaced by other transporting means.

The pumping sub-assembly 30 includes a pump suction pipe 32, usually formed of many sections placed end to end, an electrically controlled three-way bi-directional bypass/pump 34 and a filtering mechanism 36 including a controller 38 as will be described hereinbelow.

As it can be clearly seen in FIG. 1A, the distal end of the pump suction pipe 32 is provided with a supernatant sucking nozzle 40 allowing the supernatant to be laterally sucked to thereby limit the mixing of the solid matter with the supernatant to be recuperated, thereby limiting the solid matter content of the supernatant. Indeed, the nozzle 40 includes lateral apertures 42. The end 44 of the nozzle 40 has a generally conical shape to advantageously facilitate the breakage of the scum formed at the top of the supernatant, as will be described hereinafter.

It is to be noted that the lateral apertures 42 are provided with a wire mesh to prevent large suspended matter to go through.

Returning to FIG. 1, the proximate end of the pipe 32 is connected to the main port 46 of the three-way bypass/pump 34.

The three secondary ports 48, 50 and 52 of the bypass/pump 34 are connected to the sludge reservoir 26, the bottom of the supernatant reservoir 28 and to the filtering mechanism 36, via pipes 49, 51 and 53, respectively. The electrical connection between the controller 38 and the bypass/pump 34 enables the controller 38 to select to which of the secondary ports 48–52 the main aperture 46 is connected.

The filtering mechanism 36 includes a hopper-like portion 58, a continuous filter 60, mounted on a dispenser 61, going through the hopper 58, rollers 62 to support the filter 60, an electric motor 64 controlled by the controller 38, and a shredder 66 having its output connected to the sludge reservoir 26. First and second liquid sensors 68 and 70 are also provided in the hopper 58 and connected to the controller 38. The purpose of the sensors 68 and 70 will be described hereinafter.

As will be discussed hereinbelow, the sludge recuperation assembly 24 is designed to recuperate the content of septic tanks, such as, for example, septic tank 72.

The septic tank 72 includes an upstream compartment 74 and a downstream compartment 76, both containing sludge 78, supernatant 80 and a scum 82; an inlet 84 and an outlet 86. Access to the upstream compartment 74 is allowed through an opening 88 while the access to the downstream compartment 76 is given via an opening 90 which are conventionally closed by lids (not shown).

The operation of the sludge recuperation assembly 24 will now be described with respect to FIGS. 1 to 8 of the appended drawings.

FIG. 1 of the appended drawings illustrates the first step of the recuperation according to the first embodiment of the present invention. Prior to this illustrated first step, the lids (not shown) of the openings 88 and 90 have been removed therefrom and the pump suction pipe 32 has been assembled.

This first step is therefore the insertion of the distal end of the pipe 32, including the nozzle head 40, into the downstream compartment 76, under the scum 82. The controller 38 then controls the bypass/pump 34 so as to transfer a portion of the supernatant 80 from the downstream compartment 76 to the hopper 58 (see arrows 92, 94, 96 and 98). The filtering medium 60 removes the suspended matter contained in the supernatant 80 since the supernatant has to go through the filtering medium 60 to reach the supernatant reservoir 28.

It is to be noted that the supernatant is removed from the top, below the scum level, to the bottom, above the sludge level, to thereby minimise the mixing effects which reduces the amount of suspended matter in the supernatant. While the portion of the supernatant that is transferred from the tank 72 to the reservoir 28 may vary, the use of the sludge recuperation assembly 24 allows the transfer of most of the supernatant.

Figure 2:
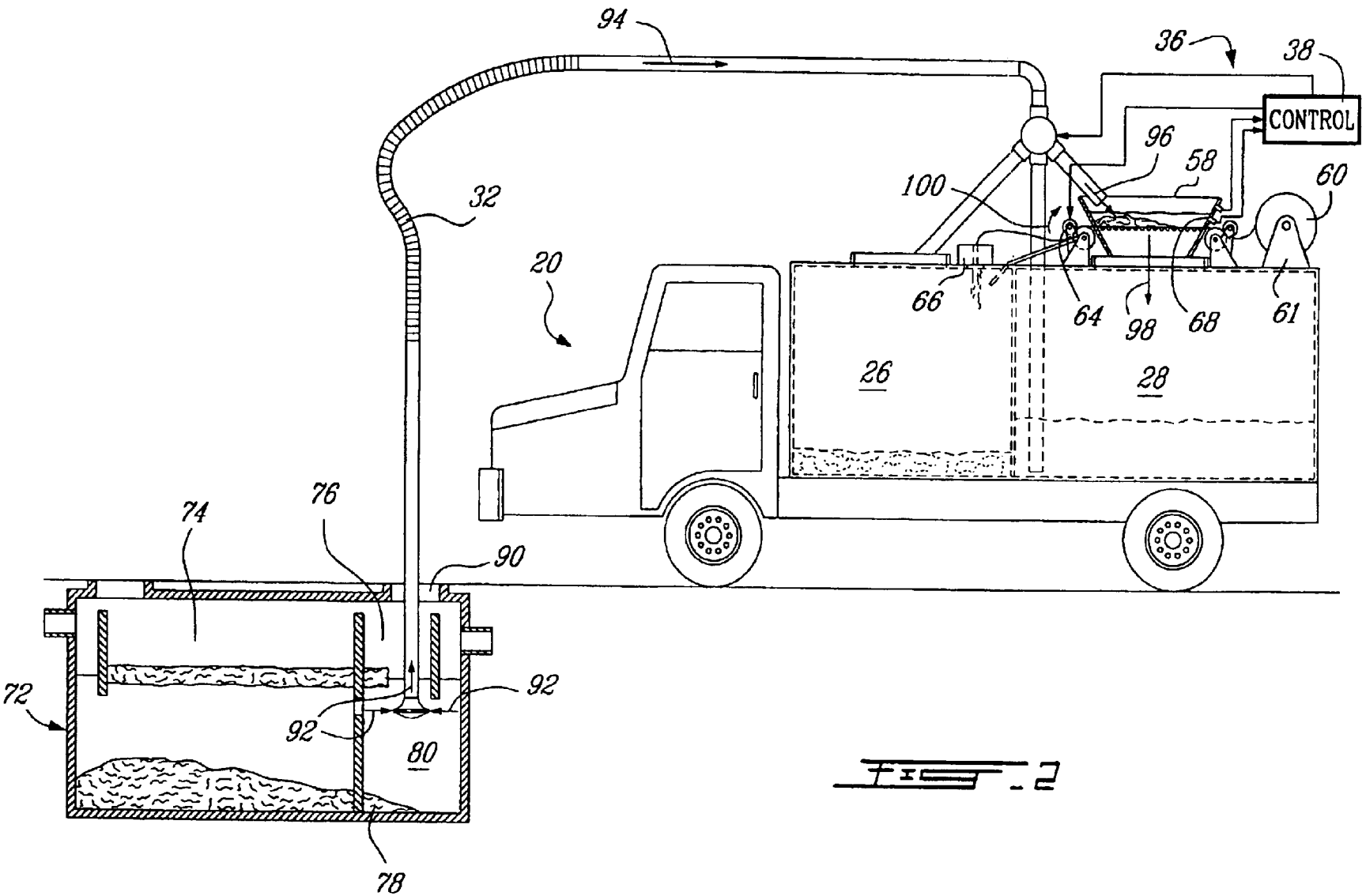
FIG. 2 is a schematic side elevational view of the mobile recuperation unit of FIG. 1, shown during the pumping of the supernatant from a septic tank.

FIG. 2 illustrates the operation of the filtering mechanism 58. Since the purpose of the filtering medium 60 is to remove the suspended matter contained in the supernatant, solid matter will accumulate on top of the filtering medium 60 to thereby clog it. When this happens, the supernatant level into the hopper 58 rises until it reaches the first liquid sensor 68.

This signal is sent to the controller 38 that activates the motor 64 that pulls a predetermined length of the filtering medium 60 from the dispenser 61 (see arrow 100). The spent portion of the filtering medium 60 is passed through the shredder 66 and the shredded filter is released into the sludge reservoir 26 since it is advantageously made of biodegradable material. Should it be made of non-biodegradable material, it could be stored in another reservoir (not shown) for ulterior disposal.

This pulling of a predetermined length of filtering medium 60 from the dispenser 61 brings a fresh filtering medium in at least a portion of the hopper 58, thereby allowing supernatant 80 therethrough, which causes the supernatant level to fall below the first sensor level.

Figure 3:
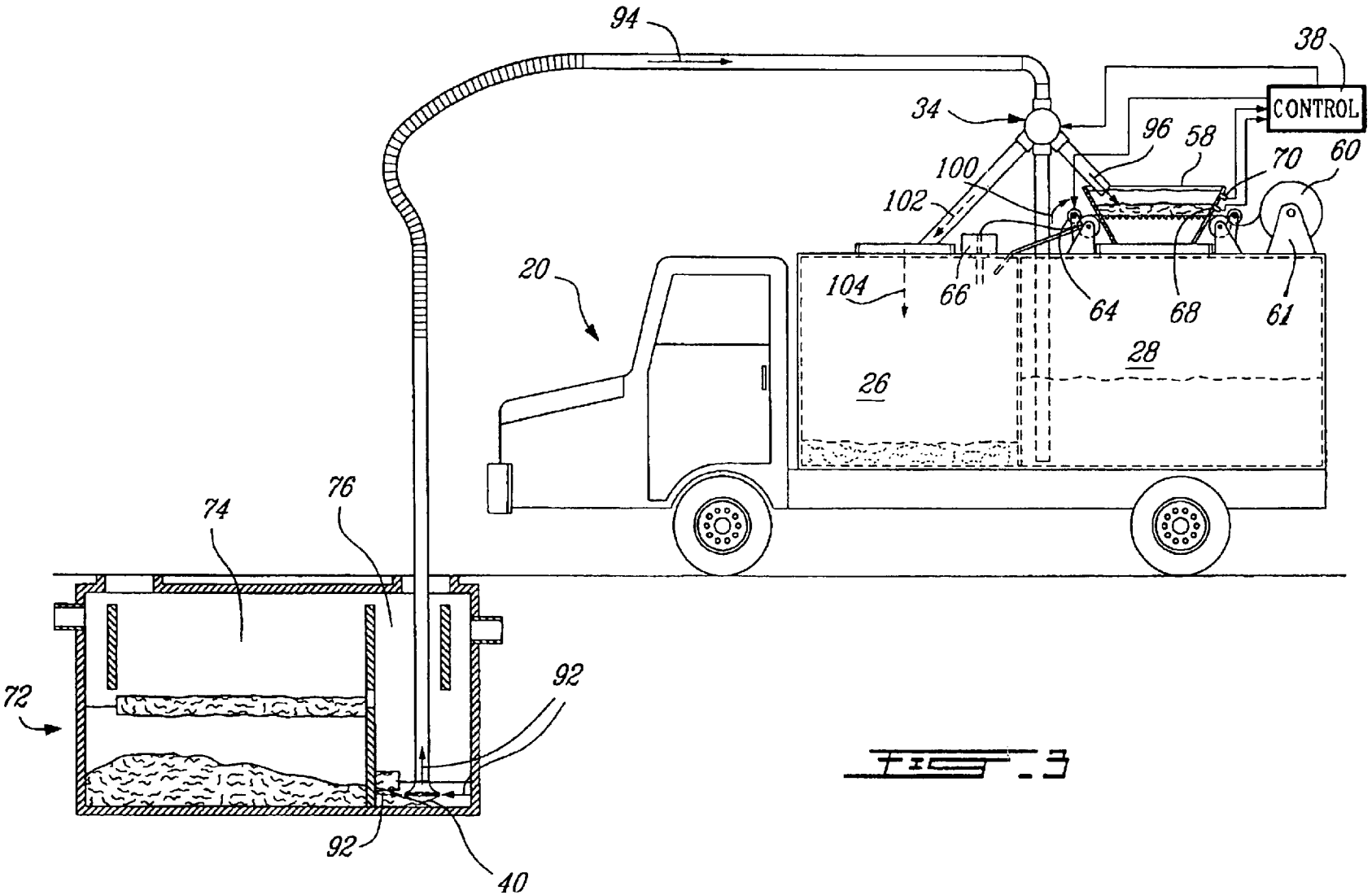
FIG. 3 is a schematic side elevational view of the mobile recuperation unit of FIG. 1, shown at the end of the pumping of the supernatant from the downstream compartment of the septic tank.

FIG. 3 of the appended drawings illustrates the end of the pumping of the supernatant 80 from the downstream compartment 76 of the tank 72. As will easily be understood by one skilled in the art, this supernatant will contain more suspended matter, even though the water is laterally sucked by the nozzle 40.

As described hereinabove with respect to FIG. 2, when the supernatant level into the hopper 58 reaches the first sensor 68, the motor 64 is activated to change at least a portion of the filtering medium 60. However, when the quantity of suspended matter in the supernatant reaches a critical level, the supernatant level in the hopper 58 will reach the second liquid sensor 70 and this signal will be monitored by the controller 38. Indeed, when the quantity of suspended matter in the supernatant is to high, the replacement of a portion of the filtering medium 60 will not be sufficient to lower the supernatant level sufficiently in the hopper 58.

The controller 38 may be configured to handle this information in two different manners. First, it may control the bypass/pump 34 so that the remainder of the supernatant is pumped in the sludge reservoir 26 (see dashed arrows 102 and 104) until the user determines that enough supernatant has been removed in this step. Secondly, it may stop the pumping process completely, thereby indicating to the user that only sludge remains in this compartment. Of course, in these two scenarios, the motor 64 is energized so as to place a new filtering medium in the hopper 58 and to empty the hopper from the supernatant contained therein.

Figure 4:
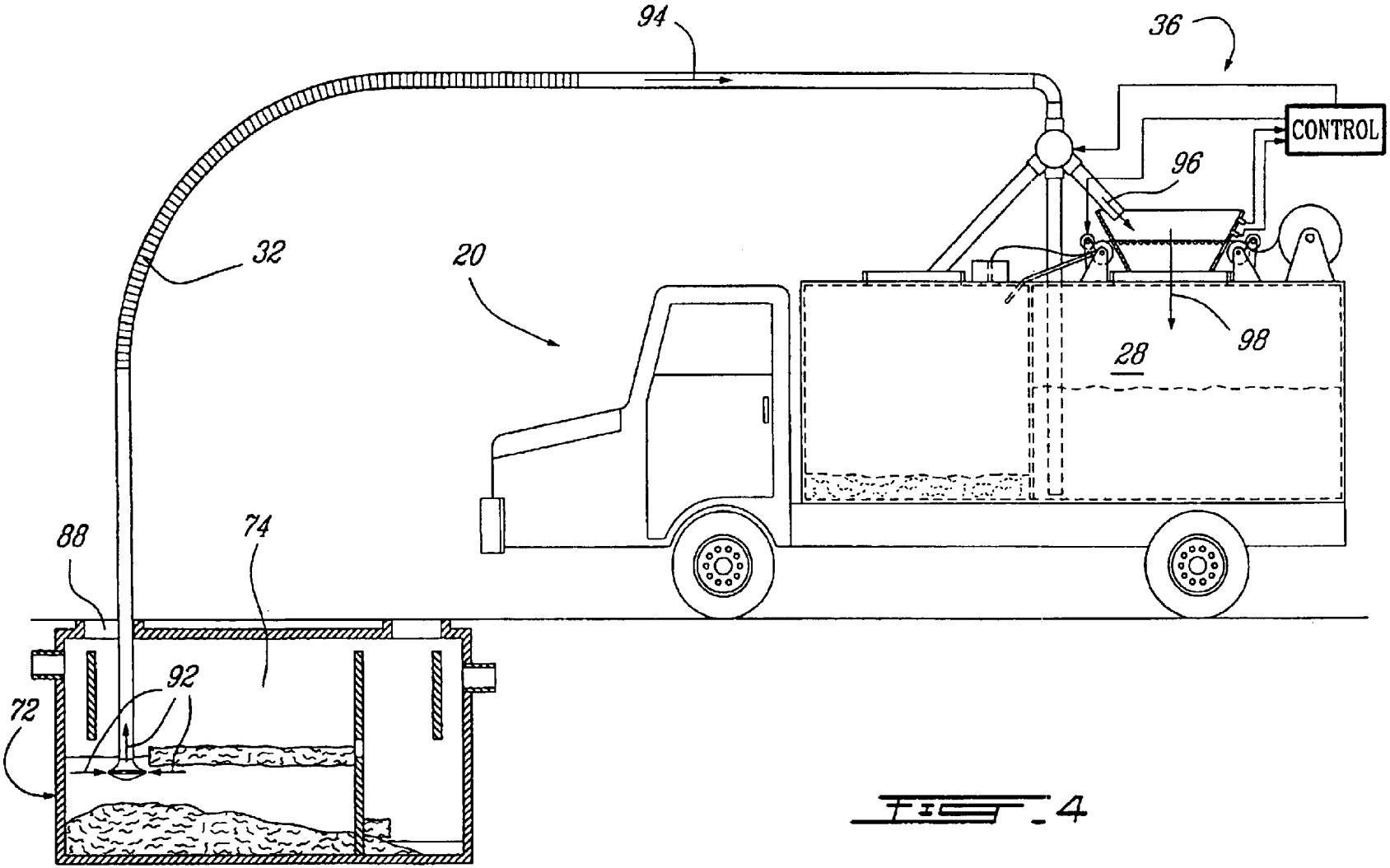
FIG. 4 is a schematic side elevational view of the mobile recuperation unit of FIG. 1, shown during the pumping of the supernatant from the upstream compartment of the septic tank.

The next step, illustrated in FIG. 4, is to remove the supernatant remaining in the upstream compartment 74. To achieve this supernatant recuperation, the distal end of the pump suction pipe 32 is inserted in the upstream compartment 74 via the opening 88. Again, the supernatant is pumped in the supernatant reservoir 28 (see arrows 92, 94, 96 and 98). Of course, the filtering mechanism 36 operates as described hereinabove with respect to FIGS. 2 and 3.

Figure 5:
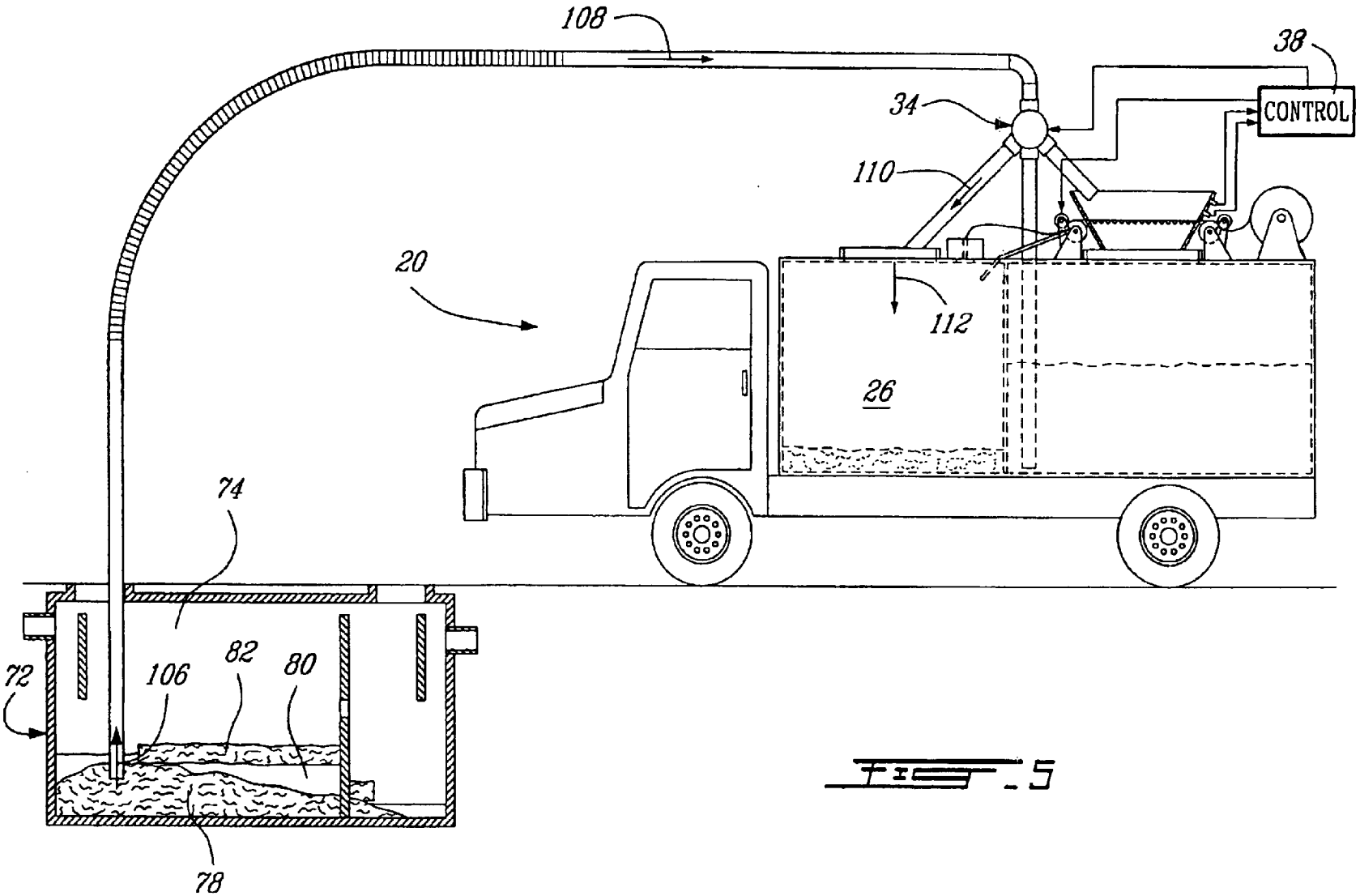
FIG. 5 is a schematic side elevational view of the mobile recuperation unit of FIG. 1, shown during the pumping of the sludge from the upstream compartment of the septic tank.

Turning now to FIG. 5 of the appended drawings, the next step is the removal of the sludge 78, of the remainder of the supernatant 80 and of the scum 82 from the upstream compartment 74 of the tank 72.

The nozzle head 40 (see FIGS. 1–3) is therefore removed from the distal end of the pump suction pipe 32 and the controller 38 instructs the bypass/pump 34 to pump the remaining content of the compartment 74 directly into the sludge reservoir 26 (see arrows 106, 108, 110 and 112). Of course, no filtering takes place at this stage.

Figure 6:
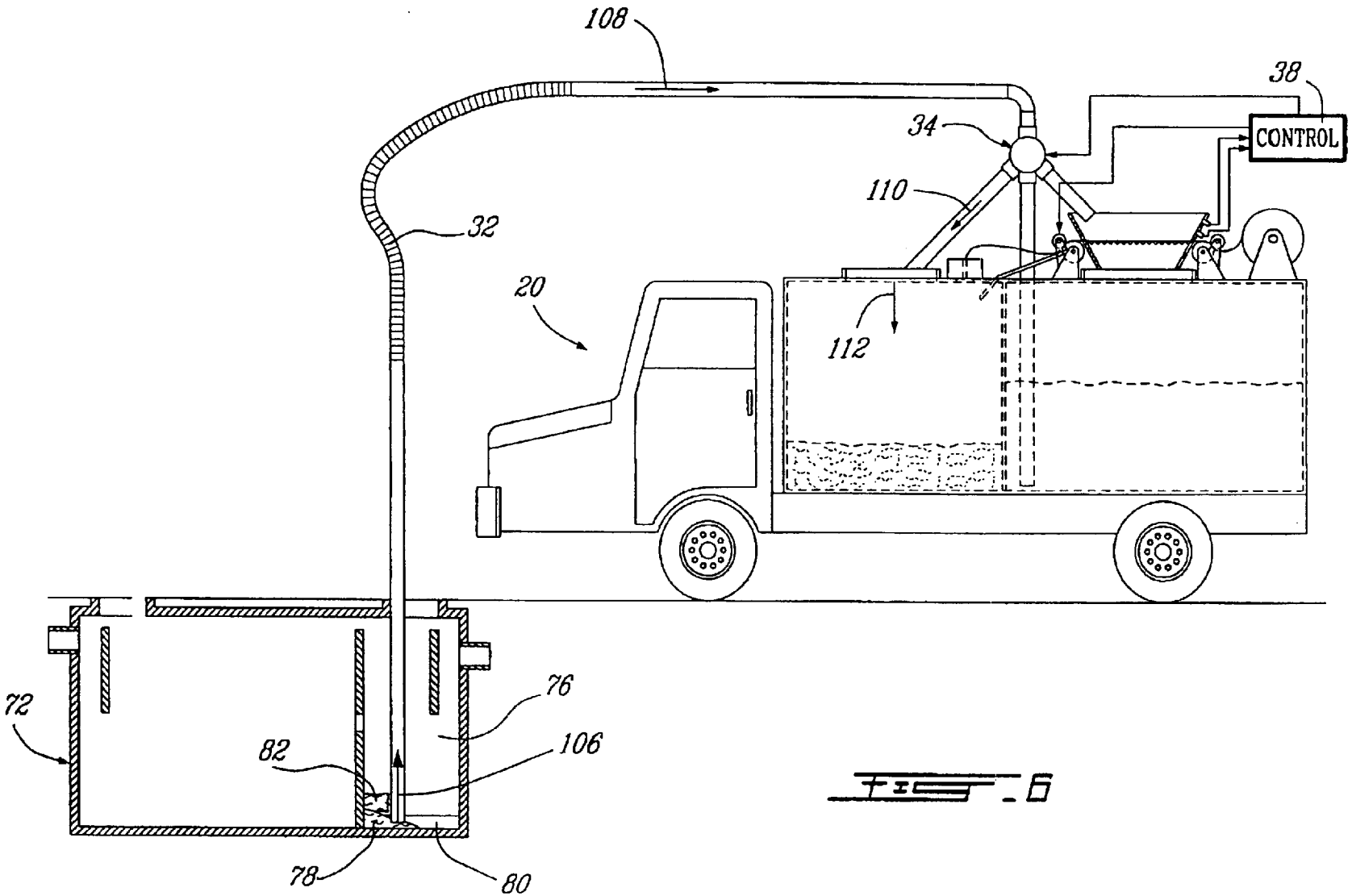
FIG. 6 is a schematic side elevational view of the mobile recuperation unit of FIG. 1, shown during the pumping of the sludge from the downstream compartment of the septic tank.

The same procedure is applied to remove the remaining content (sludge, supernatant and scum) from the downstream container 76, as can be seen from FIG. 6.

Figure 7:
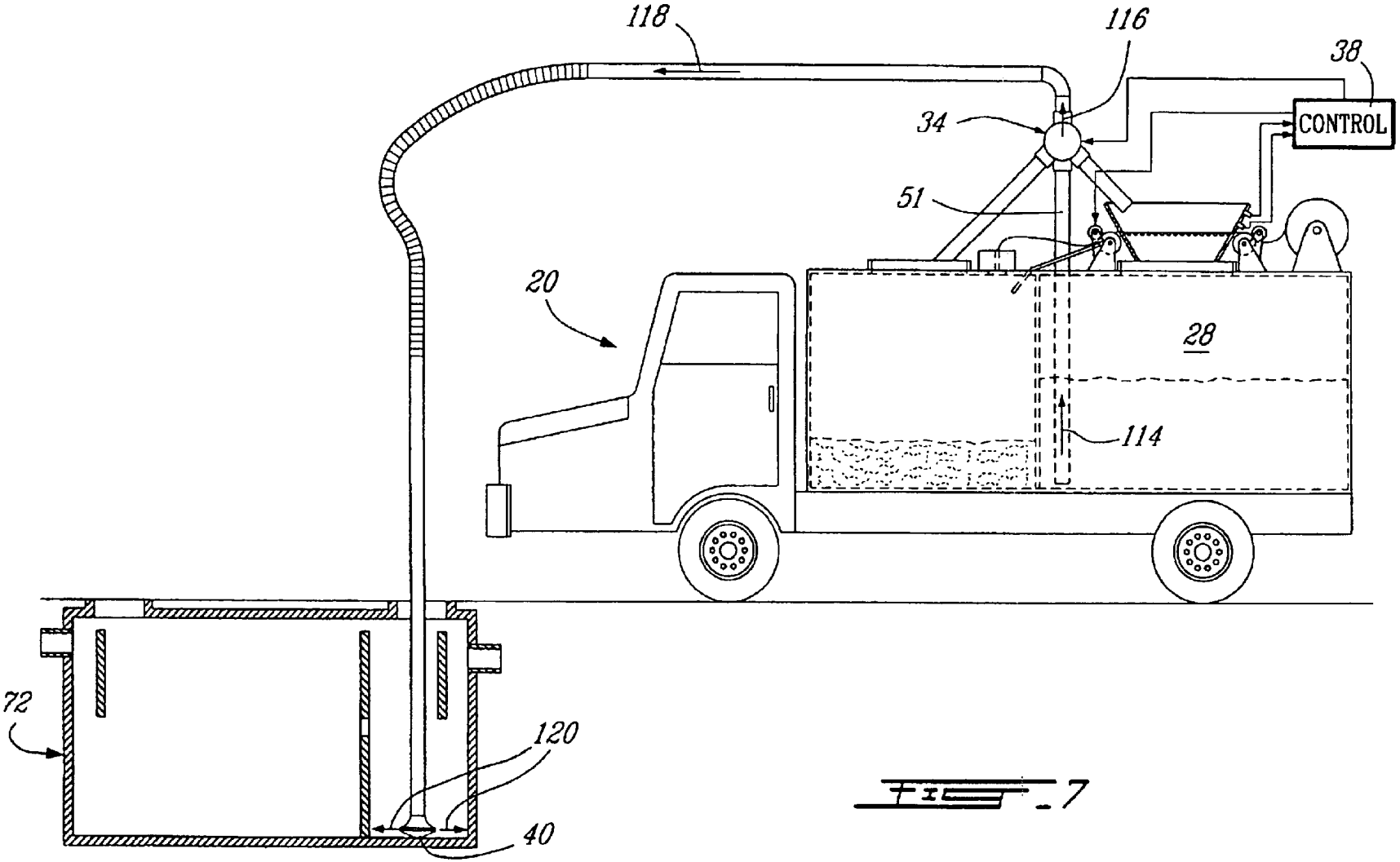
FIG. 7 is a schematic side elevational view of the mobile recuperation unit of FIG. 1, shown during the pumping back of the filtered supernatant in the septic tank.

After the step illustrated in FIG. 6 is completed, the recuperation of the content of the tank 72 is over. However, since the filtered supernatant and the sludge have been recuperated separately, the filtered supernatant contained in the supernatant reservoir 28 may be returned in the tank 72 as illustrated in FIG. 7. It has been found advantageous to replace the nozzle head 40 to the distal end of the pump suction pipe 32 and to position the nozzle head 40 at the bottom of the tank 72 to thereby minimize the stirring action of the forcefully returning water into the tank which may still contain some solid matter.

The controller 38 thereby controls the bypass/pump 34 to draw the supernatant from the reservoir 28 via the pipe 51 to return it to the tank 72 (see arrows 114, 116, 118 and 120).

Of course, as will easily be understood by one skilled in the art, the filtered supernatant could be returned to the septic tank by gravity via an aperture (not shown) provided at the bottom of the reservoir 28, therefore not necessitating the use of the pump 32 for this task.

Figure 8:
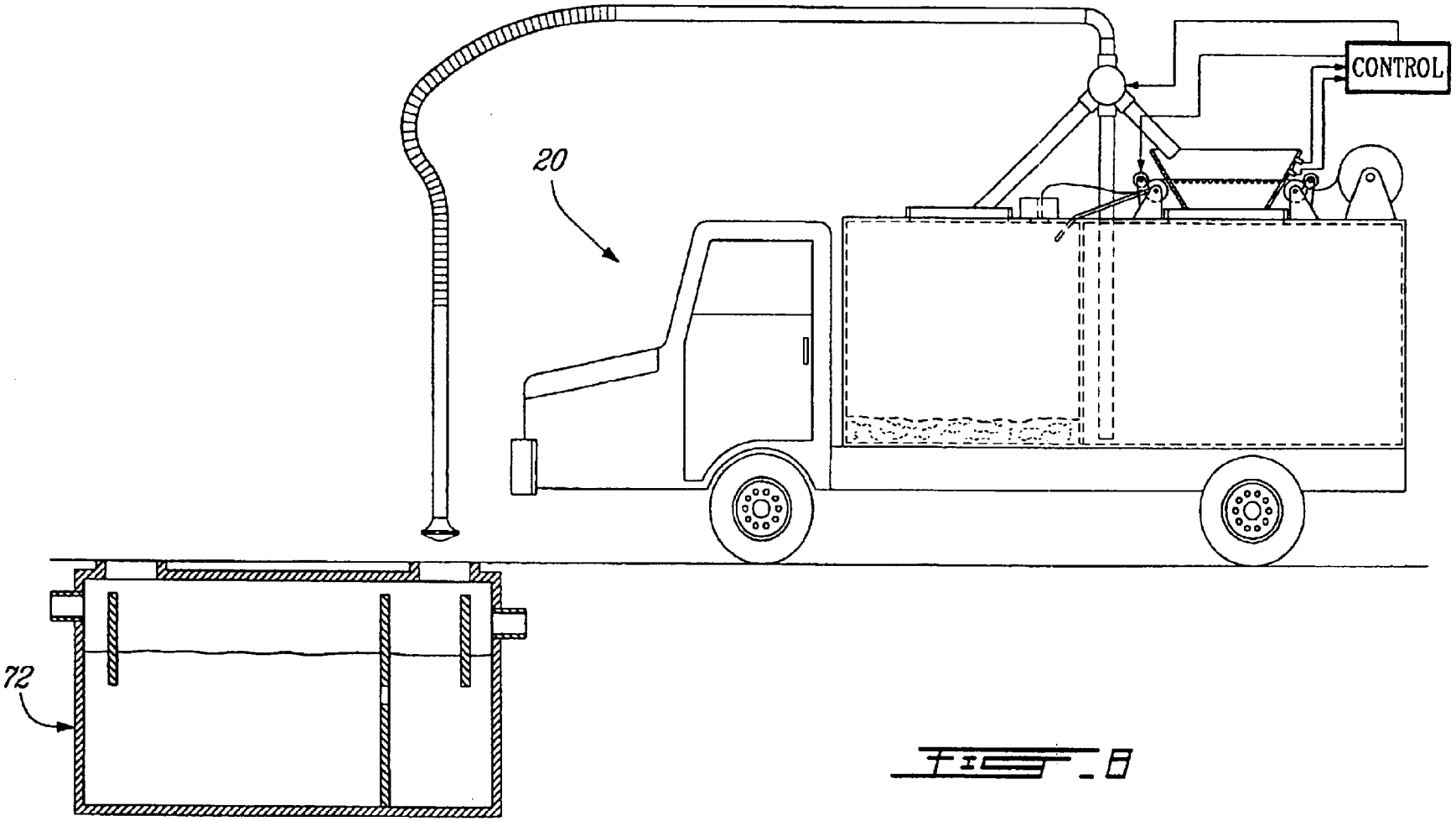
FIG. 8 is a schematic side elevational view of the mobile recuperation unit of FIG. 1, shown after the supernatant has been pumped back in the septic tank.

Finally, FIG. 8 shows the result of the method described hereinabove where the filtered supernatant has been returned to the septic tank 72.

It is to be noted that while the description hereinabove of the operation of the mobile recuperation unit 20 has been given with respect to a septic tank 72, having both its opening 88 and 90 exposed and accessible, this is not a required feature. Indeed, should only the opening 88 be exposed, the main portion of the content of the tank 72 could still be recovered.

It is also to be noted that even though the above description states that the downstream compartment 76 is emptied before the upstream compartment 74, this order could be reversed without departing from the spirit and nature of the present invention.

As will easily be understood by one skilled in the art, the filtering mechanism 36 could be replaced by an other type of filter to remove the suspended matter in the supernatant. For example, bag filters, membrane filters, sand filters, cartridge filters, centrifugal filters or other appropriate type of filters could be used. Furthermore, other filtering technologies such as, for example, a clarifier could be used to remove the suspended matter in the supernatant.

Turning now to FIGS. 9 to 14 of the appended drawings, a mobile recuperation unit 200 according to a second embodiment of the present invention will be described.

The mobile recuperation unit 200 comprises a flatbed truck 202 and a sludge recuperation assembly 204 including a sludge reservoir 206, a supernatant reservoir 208 and a pumping sub-assembly 210.

The pumping sub-assembly 210 includes a first pump suction pipe 212, usually formed of many sections connected end to end and having a relatively large diameter. The pipe 212 is connected to the sludge reservoir 206 by a first pump 214.

The pumping sub-assembly 210 also includes a second pump suction pipe 216 having a relatively small diameter. The pipe 216 is connected to a bypass 218 that allows the connection of the pipe 216 to the sludge reservoir 206 via pipe 220 and to the supernatant reservoir 208 via a pipe 222, a filtering mechanism 224 and a submersible pump 226. The filtering mechanism 224, which will be described in greater detail hereinbelow, includes a return pipe 228 to the sludge reservoir 206. The bypass 218 and the pipe 220 define a bypass assembly used to divert the flow of supernatant to the sludge reservoir as will be described hereinbelow.

Since the second pump suction pipe 216 has a generally small diameter, it may be mounted to a hose reel (not shown) for convenient storage.

A controller 230 is also provided to control the pumps 214 and 226, the bypass 218 and the filtering mechanism 224. A sensor 232 is also connected to the controller 230 to indicate the water turbidity to the controller 230, as will be described hereinafter.

Of course, other types of sensors could be used to detect the level of solid matter present in suspension in the supernatant.

As will be apparent to one skilled in the art upon reading the following description, the first pipe 212 is used to recuperate the sludge 78 and the scum 82 while the second smaller pipe 214 is used to recuperate the supernatant 80. Therefore, the distal end of the smaller pipe 214 is provided with a supernatant sucking nozzle head 234 which can be better seen from FIG. 9A. The nozzle 234 allows the supernatant 80 to be laterally sucked to thereby limit the content of solid matter to be recuperated therethrough. Indeed, the nozzle 234 includes lateral apertures 236. The end 238 of the nozzle 234 has a generally conical shape to advantageously ease the breakage of the scum formed at the top of the supernatant, as will be described hereinafter. The nozzle head 234 also includes a floating element 240 which is configured and sized to keep the lateral apertures 236 just below the scum level to thereby minimize the pumping of solid matter therethrough.

Again, it is to be noted that the lateral apertures 236 are provided with a wire mesh to prevent large suspended matter to go through.

With reference to FIGS. 9 to 14, the operation of the sludge recuperation assembly 204, according to a second embodiment of the method of the present invention, will be described. It is to be noted that the basic goals of the method described hereinabove with respect to FIGS. 1 to 8 are reached with the method that is about to be described. Indeed, the goal is still to separately recuperate the supernatant and the sludge to allow the return of the filtered supernatant to the tank 72 once the removal of the sludge therefrom is completed.

It is to be noted that since the septic tank illustrated in FIGS. 9 to 14 is identical to the tank of FIGS. 1 to 9, the same reference numerals for this tank 72 will be used.

Figures 9, 9A:
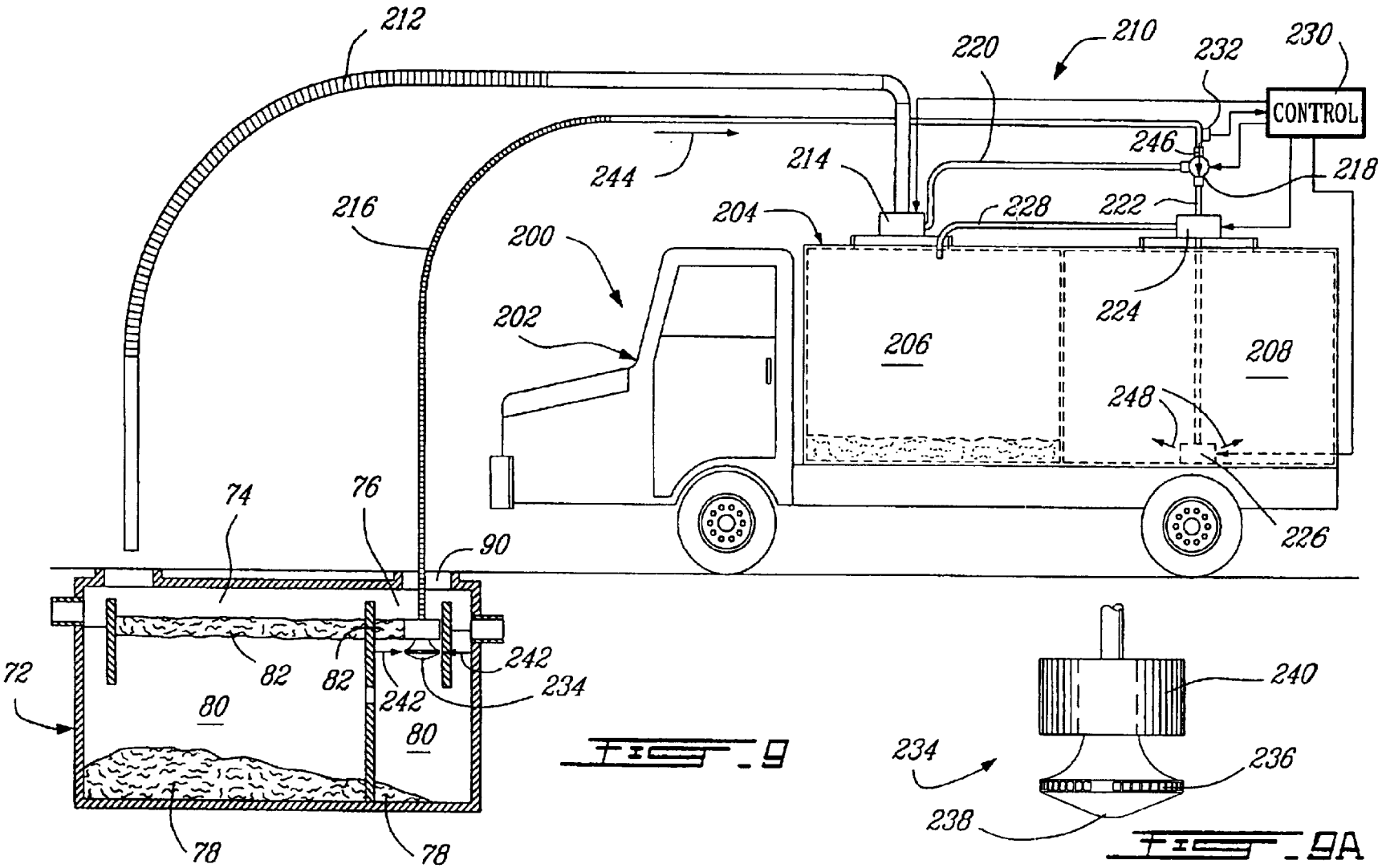
FIG. 9 is a schematic side elevational view of a mobile recuperation unit for the recuperation of septic tank content according to a second embodiment of the present invention, shown during the pumping of the supernatant from the downstream compartment of the septic tank.
FIG. 9A is a side elevational view of the nozzle of the mobile recuperation unit of FIG. 9.

The first step in the recuperation method, which is illustrated in FIG. 9, is to recuperate the supernatant from the downstream compartment 76 of the tank 72. To achieve this, the nozzle head 234 is inserted through the aperture 90 and used to break the scum 82 to reach the supernatant 80. The floating element 240 allows the supernatant recuperation to be done without the supervision of the operator, allowing the user to simultaneously assemble the various sections forming the pipe 212 (which is already shown assembled in the appended figures) to thereby reduce the total time required to empty the septic tank 72.

Arrows 242, 244, 246 and 248 show the path of the supernatant when it is pumped into the supernatant reservoir 208 by the sucking action of the submersible pump 226. As shown in FIG. 9, the controller controls the bypass 218 so that the supernatant is directed towards the supernatant reservoir 208.

It is to be noted that, at this stage, the supernatant is not filtered. As will be described hereinbelow, in this embodiment of the method of the present invention, the filtration is done immediately prior to the transfer of the supernatant back to the tank 72.

Figure 10:
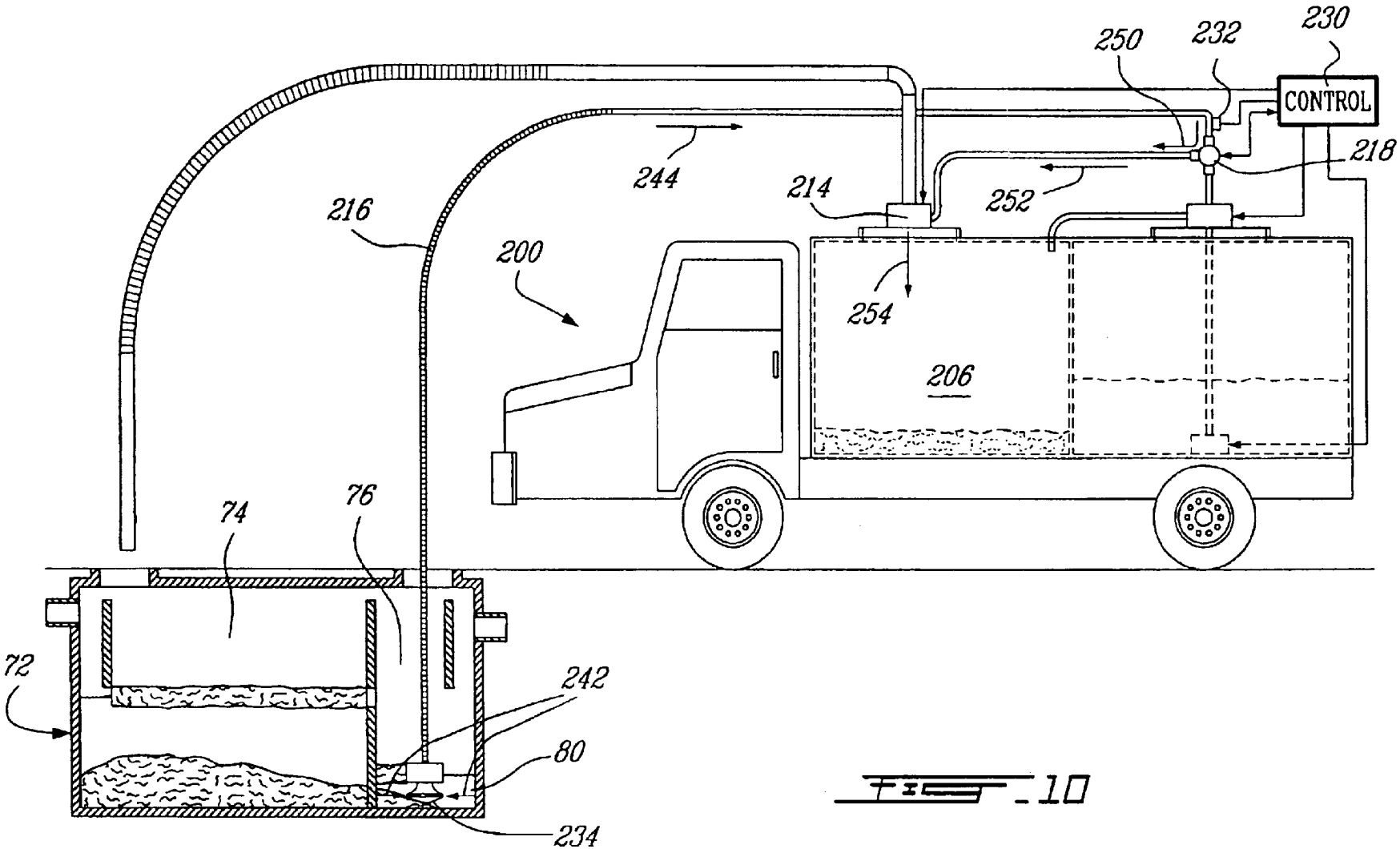
FIG. 10 is a schematic side elevational view of the mobile recuperation unit of FIG. 9, shown at the end of the pumping of the supernatant from the downstream compartment of the septic tank.

FIG. 10 illustrates the end of the removal of the supernatant from the downstream compartment 76. As discussed hereinabove, the suspended matter content of the supernatant remaining in the downstream compartment 76 increases when the bottom portion of the compartment 76 is reached. This increases the turbidity of the supernatant. The sensor 232 continuously monitors the turbidity of the supernatant and supplies this data to the controller 230. When the turbidity level reaches a predetermined and programmable limit, the controller 230 directs the supernatant to the sludge reservoir 206 via the bypass 218 and the pump 214 (see arrows 242, 244, 250, 252 and 254), or stops the pump.

Figure 11:
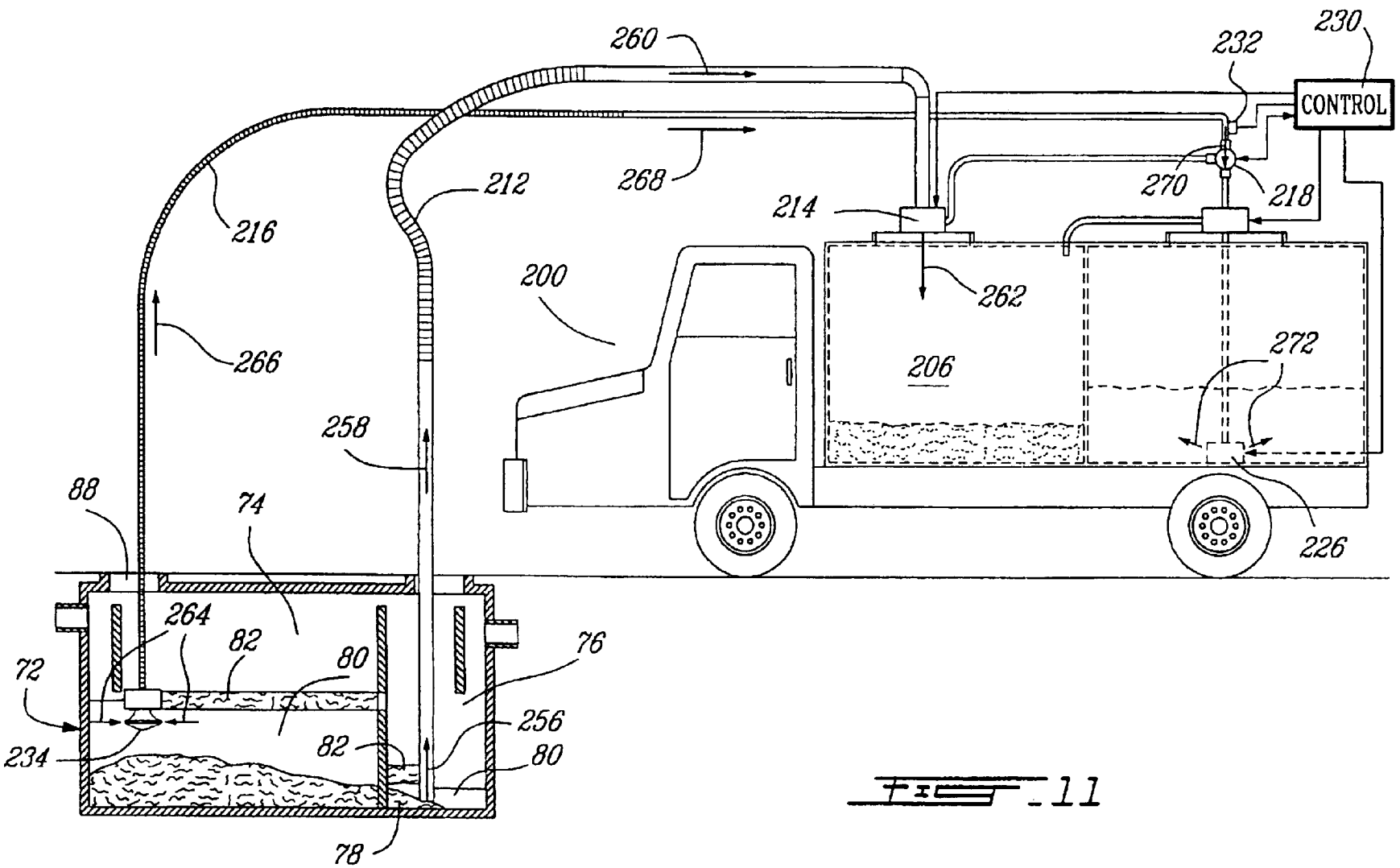
FIG. 11 is a schematic side elevational view of the mobile recuperation unit of FIG. 9, shown during the simultaneous pumping of the supernatant from the upstream compartment of the septic tank and the sludge from the downstream compartment of the septic tank.

In FIG. 11, two steps are done simultaneously.

First, the relatively large diameter pipe 212 is used to recuperate the sludge 78, the remaining supernatant 80 and the scum 82 from the downstream compartment 76 of the tank 72 and to pump this content in the sludge reservoir 206 (see arrows 256, 258, 260 and 262) via pump 214 controlled by the controller 230.

Secondly, the nozzle head 234 is inserted in the upstream compartment 74 via the aperture 88 to break the scum 82 and recuperate the supernatant 80 therefrom via the submersible pump 226 (see arrows 264, 266, 268, 270 and 272). Of course, the turbidity of the supernatant is monitored by the sensor 232, as discussed hereinabove.

Figure 12:
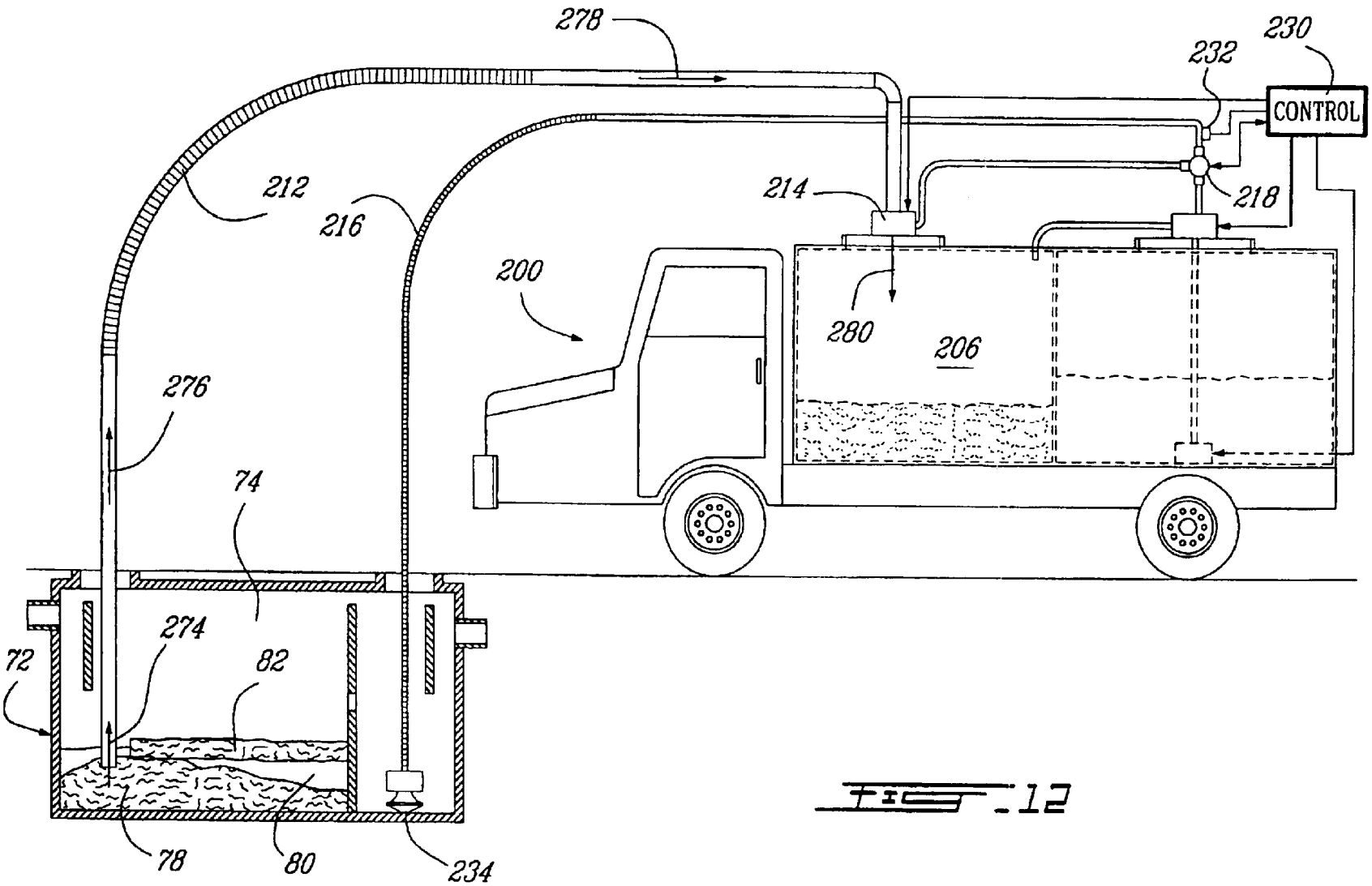
FIG. 12 is a schematic side elevational view of the mobile recuperation unit of FIG. 9, shown during the pumping of the sludge from the upstream compartment of the septic tank.

When the major portion of the supernatant is recuperated from the upstream compartment 74, the relatively large diameter pipe 212 is inserted in this compartment to remove the remainder of its content, i.e. the sludge 78, the supernatant 80 and the scum 82 (see FIG. 12). The pump 214 is used to transfer this content to the sludge compartment 206 (see arrows 274, 276, 278 and 280). While this is done, the smaller diameter pipe 216 may be positioned in the downstream compartment for the subsequent pumping of the supernatant back in the tank 72.

Figure 13:
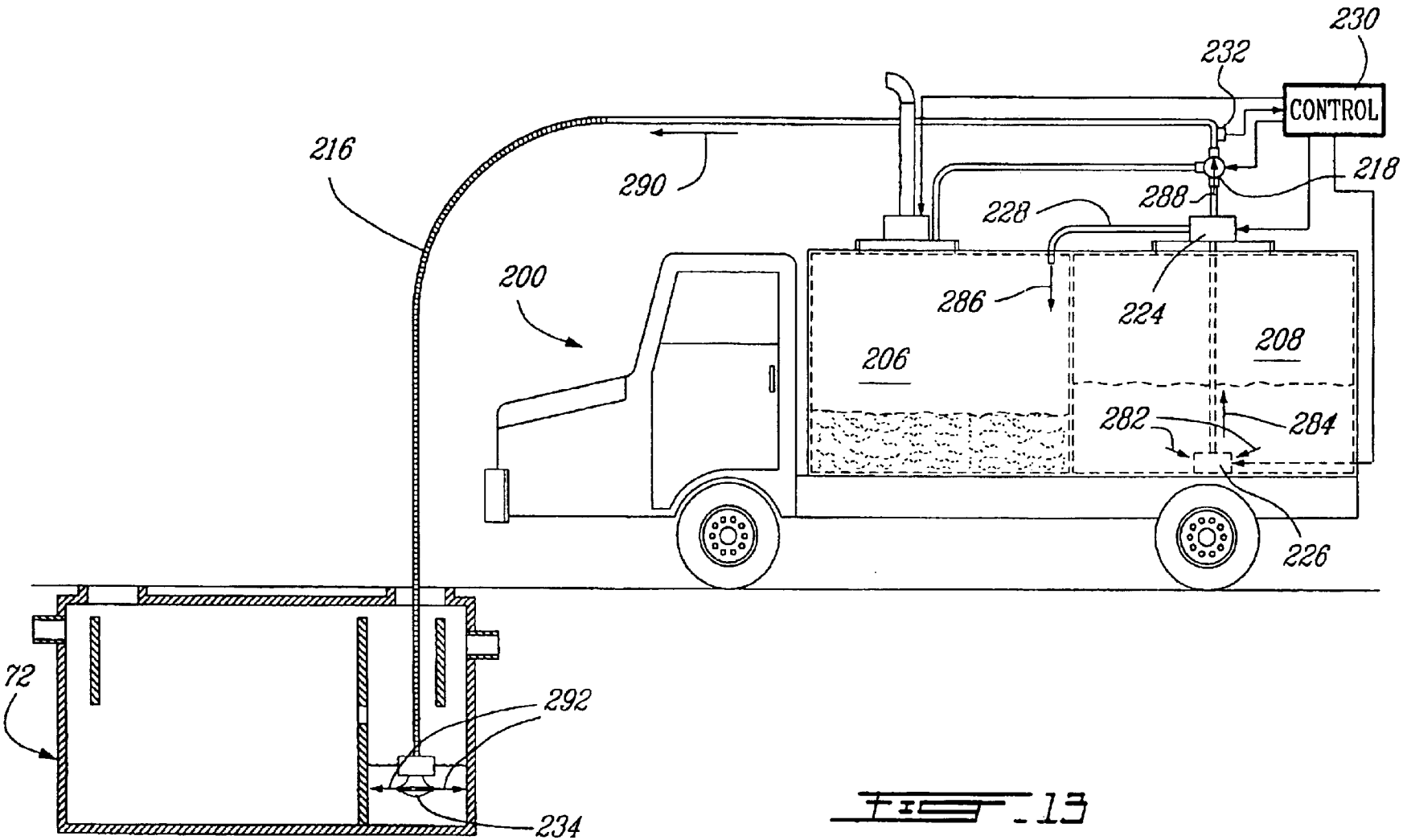
FIG. 13 is a schematic side elevational view of the mobile recuperation unit of FIG. 9, shown during the pumping back of the filtered supernatant to the downstream compartment of the septic tank.

FIG. 13 illustrates this supernatant transfer back to the tank 72 step from the supernatant reservoir 208. The controller 230 energizes the pump 226 so that the flow of the supernatant is directed towards the tank 72 (see arrows 282 and 284). The controller 230 also energizes the filtering mechanism 224 to thereby filter the supernatant before it is returned to the tank 72. The filtered suspended matter (not shown) is returned to the sludge reservoir 206 via the pipe 228 (see arrow 286. The filtered supernatant is thus returned to the tank 72 (see arrows 288, 290 and 292). Since the nozzle head 234 floats, the operator may take this pumping time to disassemble the pipe 212 to thereby reduce the total time required for the recuperation operation.

Again, as will easily be understood by one skilled in the art, the filtering mechanism 224 may use different known technologies to remove the suspended matter in the supernatant. For example, bag filters, membrane filters, sand filters, cartridge filters, centrifugal filters or other appropriate type of filters could be used. Furthermore, other filtering technologies such as, for example, a clarifier could be used to remove the suspended matter in the supernatant.

Figure 14:
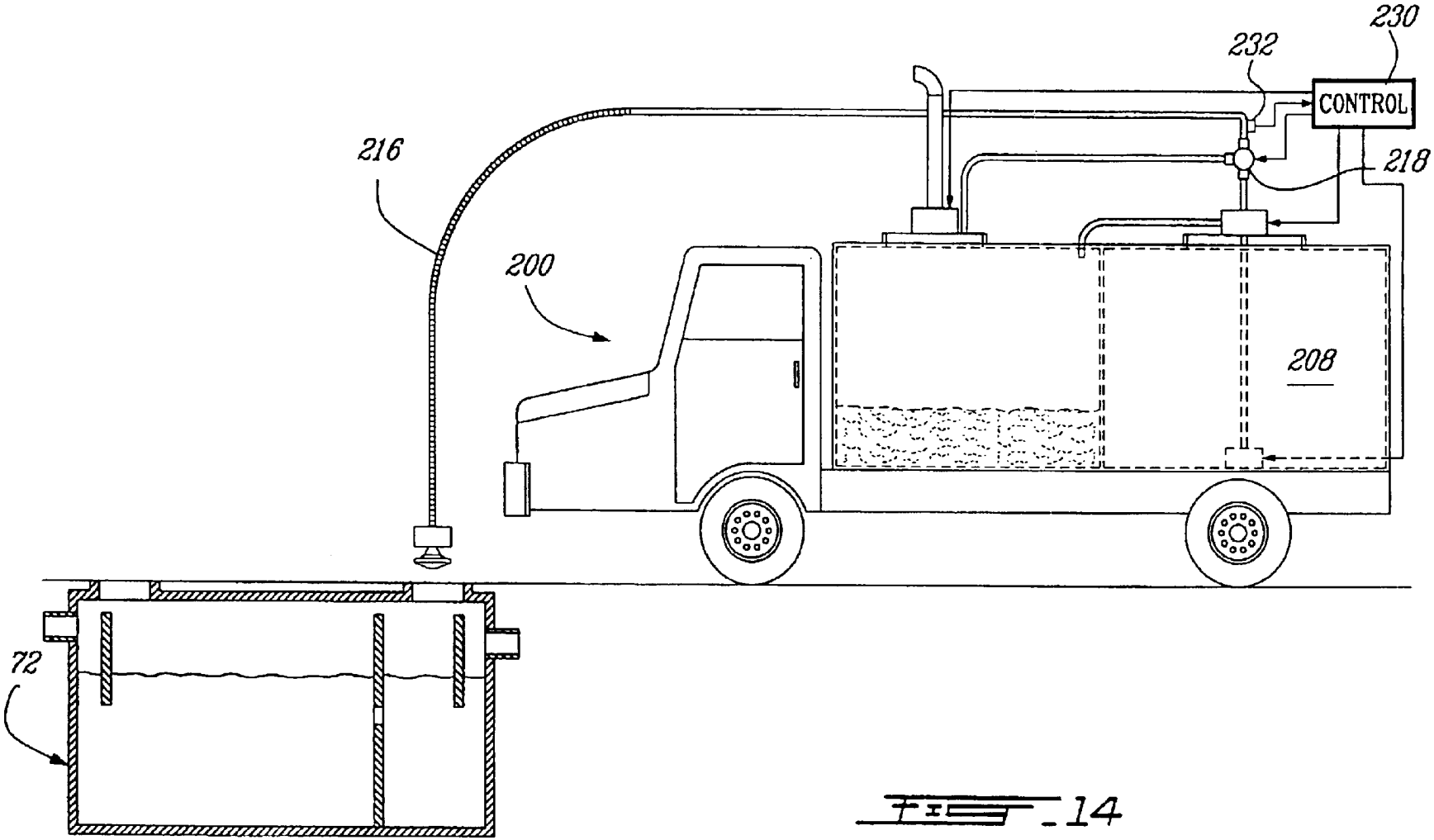
FIG. 14 is a schematic side elevational view of the mobile recuperation unit of FIG. 9, shown when the pumping back operation is completed.

Finally, FIG. 14 illustrates the result of the operation, when the supernatant is fully returned to the tank 72.

Of course, as will readily be understood by one skilled in the art, the filtering mechanism 224 could be replaced by a filtering mechanism 36 as illustrated in FIGS. 1 to 8 to filter the supernatant before it reaches the supernatant reservoir 208.

The filtering mechanism 224 could also include a prefiltering assembly (not shown) to remove the relatively large solid particles when the supernatant is transferred to the supernatant reservoir 208 and, as discussed hereinabove, a filter to remove the smaller solid particles in suspension therein when the supernatant is transferred back to the tank 72.

Turning now to FIGS. 15 to 19 of the appended drawings, a mobile recuperation unit 300 according to a third embodiment of the present invention will be described.

The mobile recuperation unit 300 comprises a flatbed truck 302 and a sludge recuperation assembly 304 including a sludge reservoir 306, a supernatant reservoir 308 and a pumping sub-assembly 310.

The pumping sub-assembly 310 includes a first pump suction pipe 312, usually formed of many sections connected end to end and having a relatively large diameter. The pipe 312 is connected to the sludge reservoir 306.

The pumping sub-assembly 310 also includes a second pump suction pipe 314 having a relatively small diameter. The pipe 314 is connected to a pre-filter 316 that allows the connection of the pipe 314 to the supernatant reservoir 308. The pre-filter 316 includes a return pipe 318 to the sludge reservoir 306. Therefore, the relatively large solid matter recuperated by the pre-filter 316 are transferred to the sludge reservoir 306.

Since the second pump suction pipe 314 has a generally small diameter, it may be mounted to a hose reel (not shown) for convenient storage.

The pumping sub-assembly 310 further includes a vacuum pump 320 connected to the reservoirs 306 and 308 by electrically controlled valves 322 and 324, respectively.

A turbidity sensor 326 is associated with the pipe 314 to determine the turbidity of the supernatant as discussed hereinabove with respect to FIGS. 9–14.

A filter 328 is also provided to filter the supernatant before it is returned to the septic tank, as will be described hereinbelow. This filter 328 is connected to a lower outlet (not shown) of the supernatant reservoir 308 via an electrically controlled valve 330.

A controller 332 is also provided to control the vacuum pump 320, the valves 322, 324 and 330 and the pre-filter 316.

As will be apparent to one skilled in the art upon reading the following description, the first pipe 312 is used to recuperate the sludge 78 and the scum 82 while the second smaller pipe 314 is used to recuperate the supernatant 80. Therefore, the distal end of the smaller pipe 314 is provided with a supernatant sucking nozzle head 234 identical to the nozzle head discussed hereinabove with respect to FIGS. 9–14.

As will easily be understood by one skilled in the art, the vacuum pump is used to create a partial vacuum in the reservoirs 306 and 308 via the valves 322 and 324. This partial vacuum will create a suction in the corresponding pipe to thereby draw the content from the septic tank 72 as will be described in greater detail hereinbelow.

With reference to FIGS. 15 to 19, the operation of the sludge recuperation assembly 304, according to a third embodiment of the method of the present invention, will be described. Again, the goal is to separately recuperate the supernatant and the sludge to allow the return of the filtered supernatant to the tank 72 once the removal of the sludge therefrom is completed.

It is to be noted that since the septic tank illustrated in FIGS. 15 to 19 is identical to the tank of FIGS. 1 to 9, the same reference numerals for this tank 72 will be used.

Figure 15:
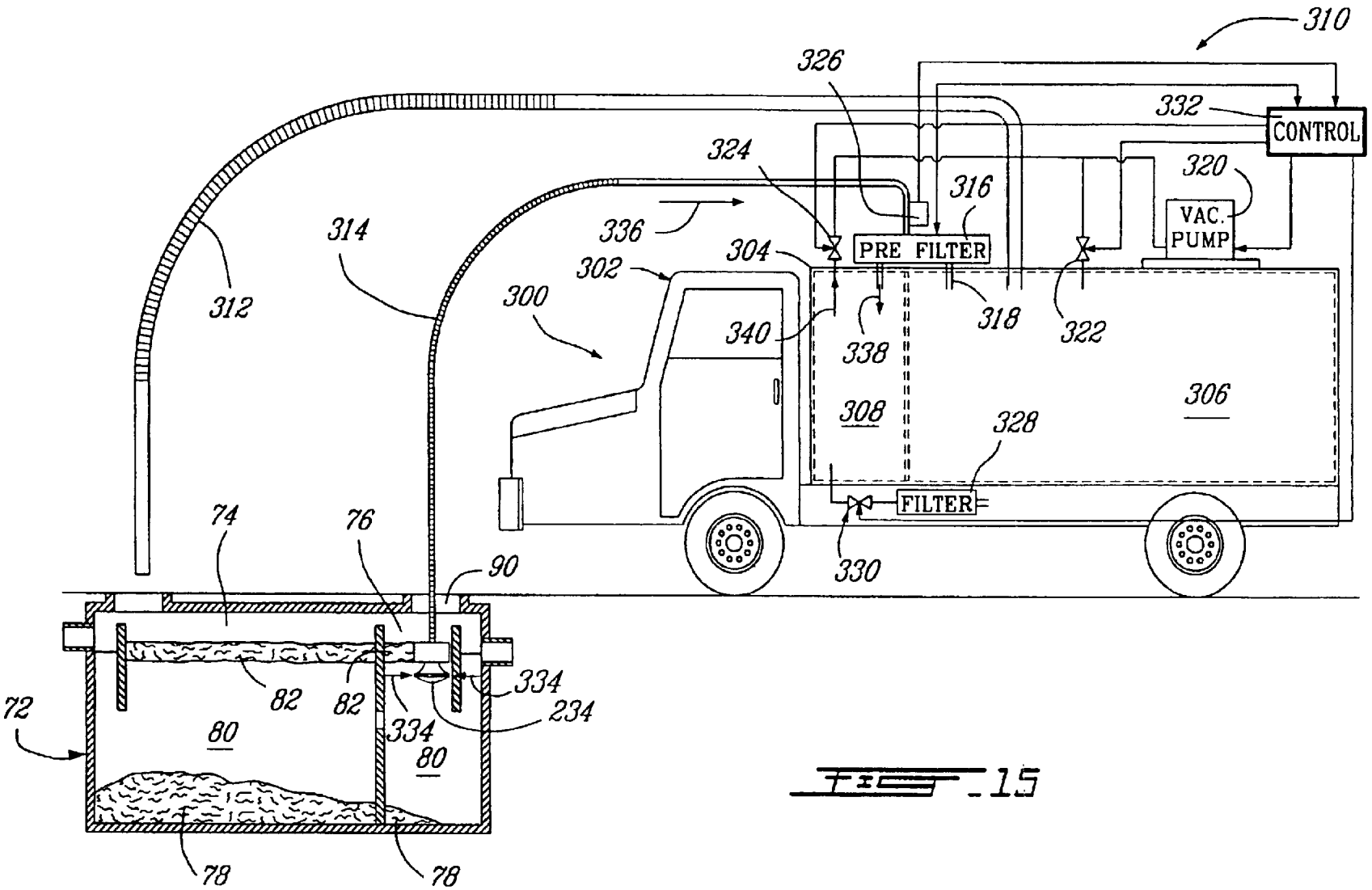
FIG. 15 is a schematic side elevational view of a mobile recuperation unit for the recuperation of septic tank content according to a third embodiment of the present invention, shown during the pumping of the supernatant from the downstream compartment of the septic tank.

The first step in the recuperation method, which is illustrated in FIG. 15, is to recuperate the supernatant from the downstream compartment 76 of the tank 72. To achieve this, the nozzle head 234 is inserted through he aperture 90 and used to break the scum 82 to reach the supernatant 80. The floating element 240 allows the supernatant recuperation to be done without the supervision of the operator, allowing the simultaneous assembly of the various sections forming the pipe 312 (which is already shown assembled in the appended figures) to thereby reduce the total time required to empty the septic tank 72.

Arrows 334, 336 and 338 show the path of the supernatant when it is pumped in the supernatant reservoir 308 by the sucking action of the partial vacuum created in the reservoir 308 by the vacuum pump 320 (see arrow 340). The controller 332 therefore energizes the pump 320 and opens the valve 324 to create this depressurization of the reservoir 308.

It is to be noted that, at this stage, the supernatant is only pre-filtered by the pre-filter 316 that removes the large solid elements from the supernatant but not the suspended matter therein. As will be described hereinbelow, in this third embodiment of the method of the present invention, the filtration is done immediately prior to the return of the supernatant to the tank 72.

Figure 16:
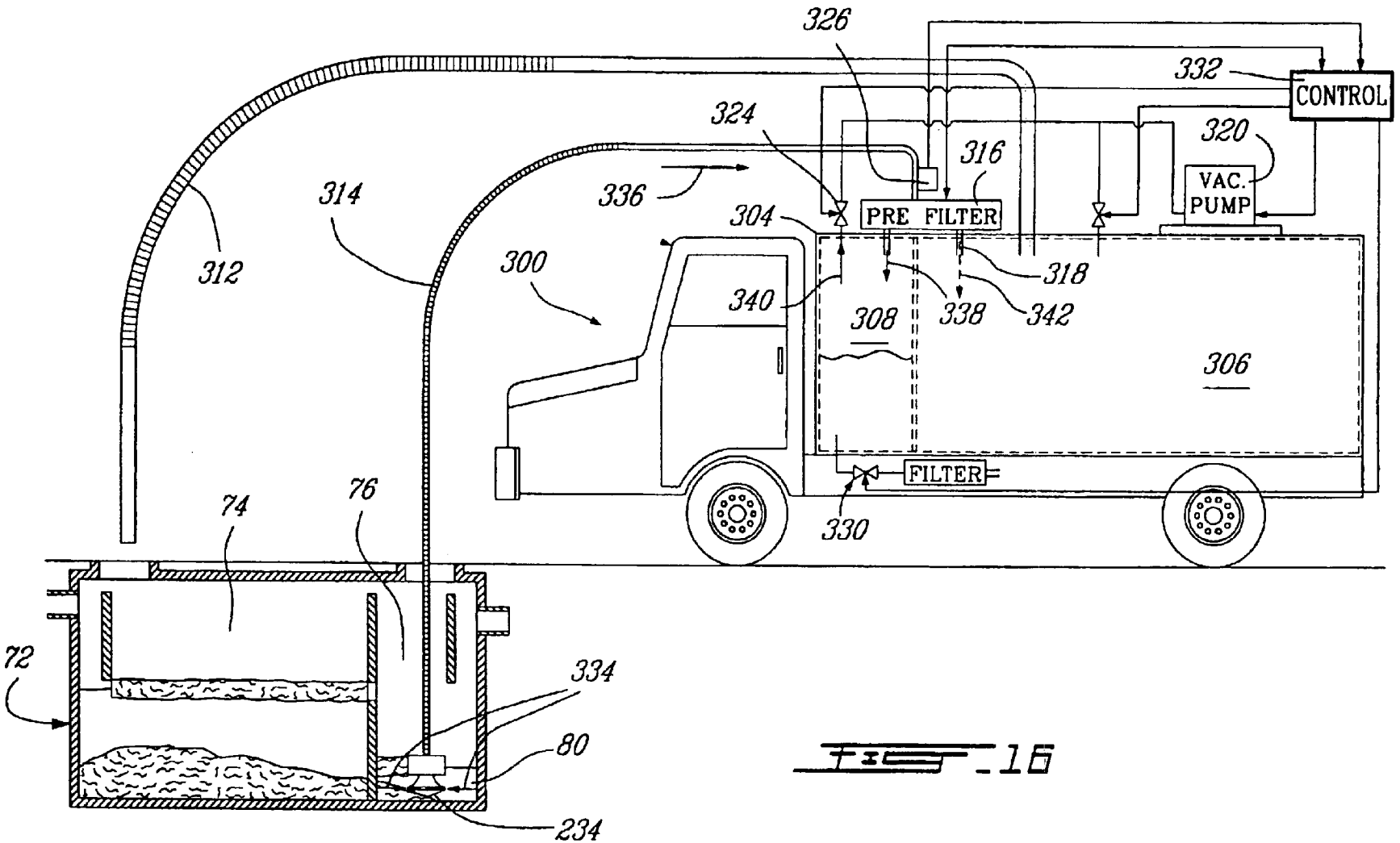
FIG. 16 is a schematic side elevational view of the mobile recuperation unit of FIG. 15, shown at the end of the pumping of the supernatant from the downstream compartment of the septic tank.

FIG. 16 illustrates the end of the removal of the supernatant from the downstream compartment 76. As discussed hereinabove, the suspended matter content of the supernatant remaining in the downstream compartment 76 increases when the bottom portion of the compartment 76 is reached. This increases the turbidity of the supernatant. The sensor 326 continuously monitors the turbidity of the supernatant and supplies this data to the controller 332. When the turbidity level reaches a predetermined and programmable limit, the controller 332 stops the recuperation of the supernatant by closing the valve 324 and/or by stopping the vacuum pump 320.

The solid matter recuperated by the pre-filter is transferred to the sludge reservoir 306, when required, via the return pipe 318 (see arrow 342).

Figure 17:
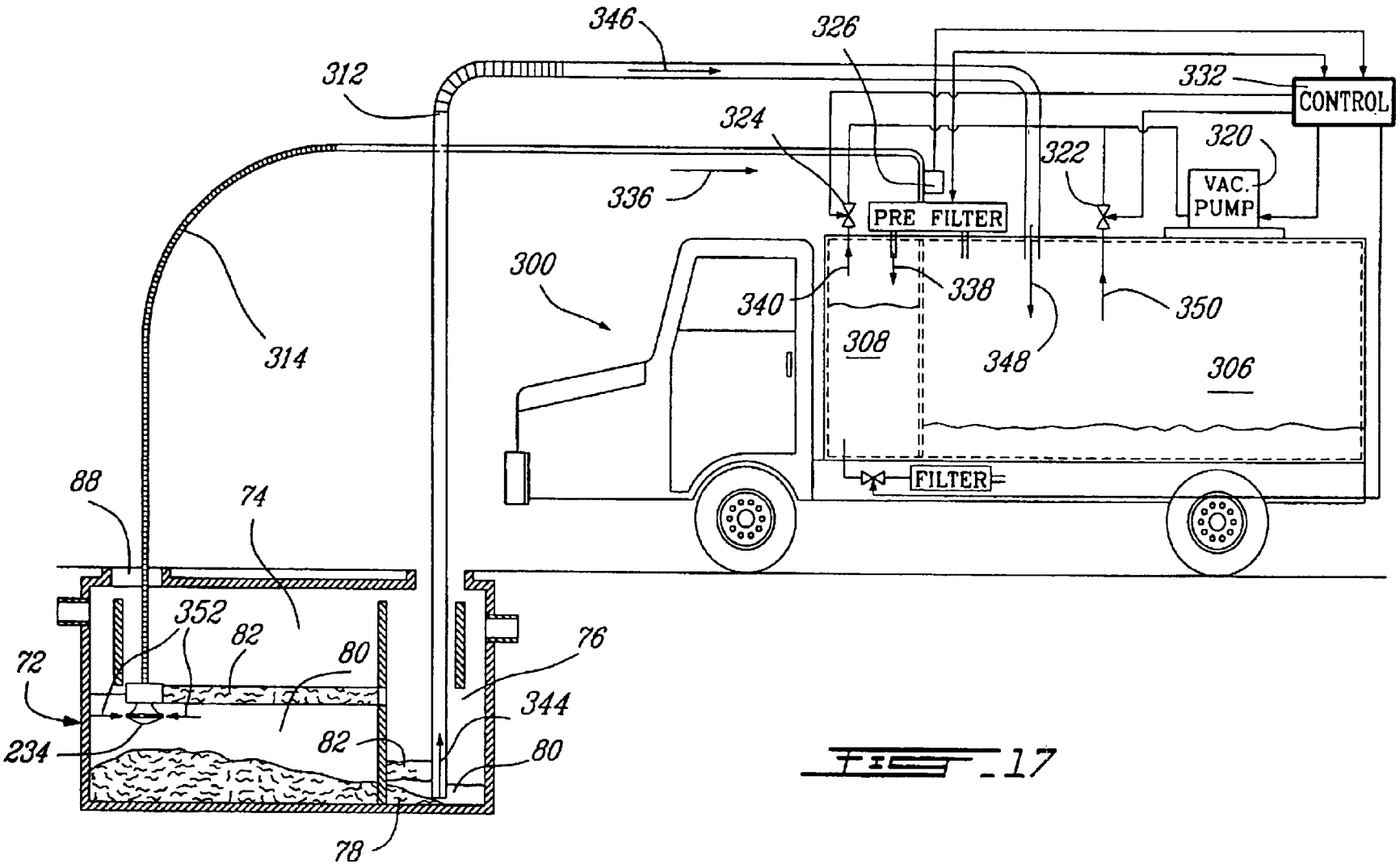
FIG. 17 is a schematic side elevational view of the mobile recuperation unit of FIG. 15, shown during the simultaneous pumping of the supernatant from the upstream compartment of the septic tank and the sludge from the downstream compartment of the septic tank.

In FIG. 17, two steps are done simultaneously.

First, the relatively large diameter pipe 312 is used to recuperate the sludge 78, the remaining supernatant 80 and the scum 82 from the downstream compartment 76 of the tank 72 and to pump this content in the sludge reservoir 306 (see arrows 344, 346 and 348) via the sucking action of the partial vacuum created in the reservoir 308 by the vacuum pump 320 (see arrow 350).

Secondly, the nozzle head 234 is inserted in the upstream compartment 74 via the aperture 88 to break the scum 82 and recuperate the supernatant 80 (see arrows 352, 336 and 338) therefrom via sucking action of the partial vacuum created in the reservoir 308 by the vacuum pump 320 (see arrow 340). Of course, the turbidity of the supernatant is monitored by the sensor 326, as discussed hereinabove.

To simultaneously draw the content of the tank 72 via pipes 312 and 314, the two valves 322 and 324 are opened by the controller 332 and the vacuum pump 320 is energised.

Figure 18:
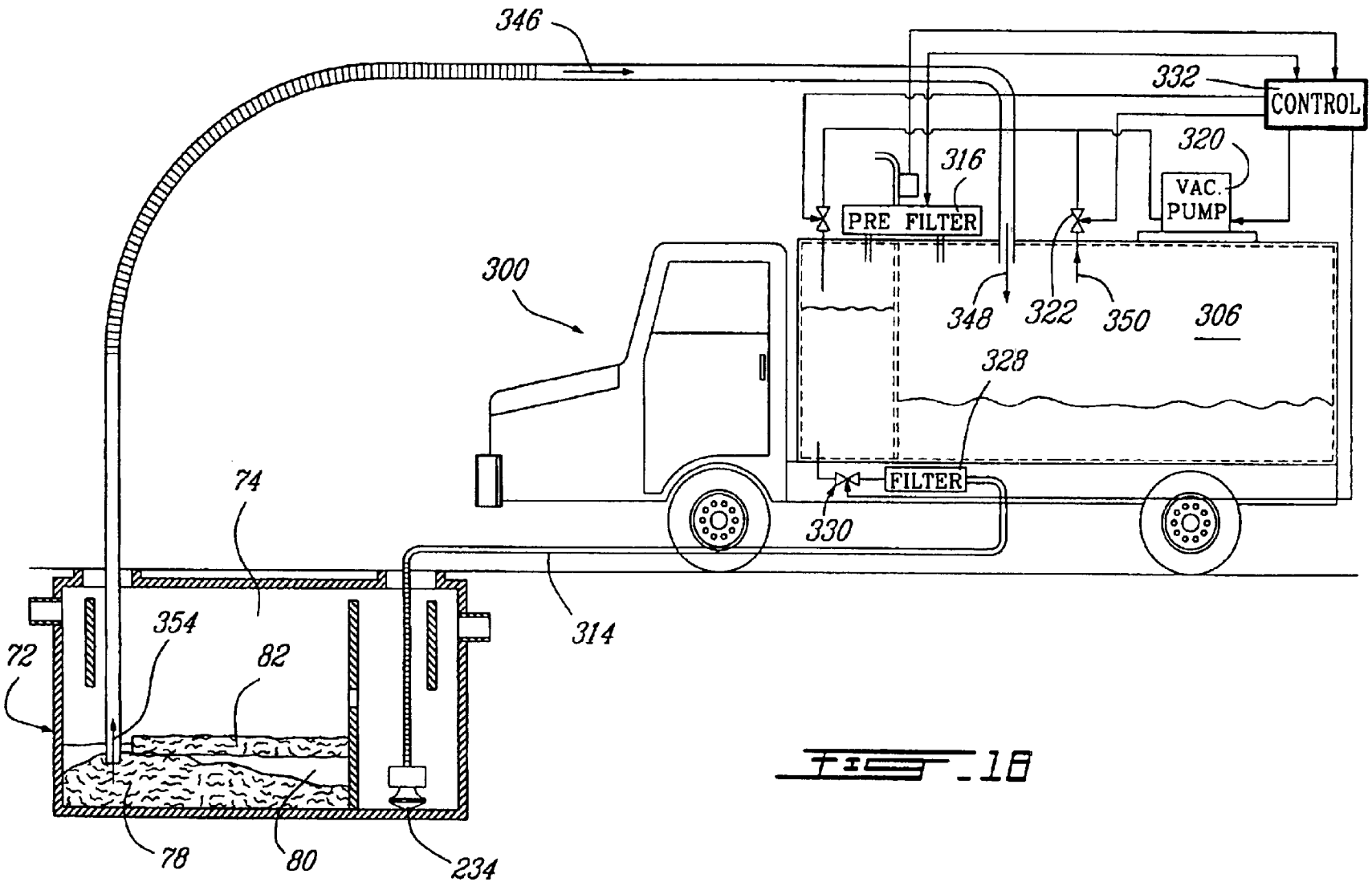
FIG. 18 is a schematic side elevational view of the mobile recuperation unit of FIG. 15, shown during the pumping of the sludge from the upstream compartment of the septic tank.

As can be seen in FIG. 18, when the major portion of the supernatant is recuperated from the upstream compartment 74, the relatively large diameter pipe 312 is inserted in this compartment to remove the remainder of its content, i.e. the sludge 78, the supernatant 80 and the scum 82 (see FIG. 12). The vacuum pump 320 is used as discussed hereinabove to transfer this content to the sludge compartment 306 (see arrows 354, 346 and 348).

While this is done, the smaller diameter pipe 314 may be disconnected from the pre-filter 316 and connected to an output (not shown) of the filter 328. The distal end of the pipe 314 may be positioned in the downstream compartment 76 for the subsequent transfer of the supernatant back in the tank 72.

Figure 19:
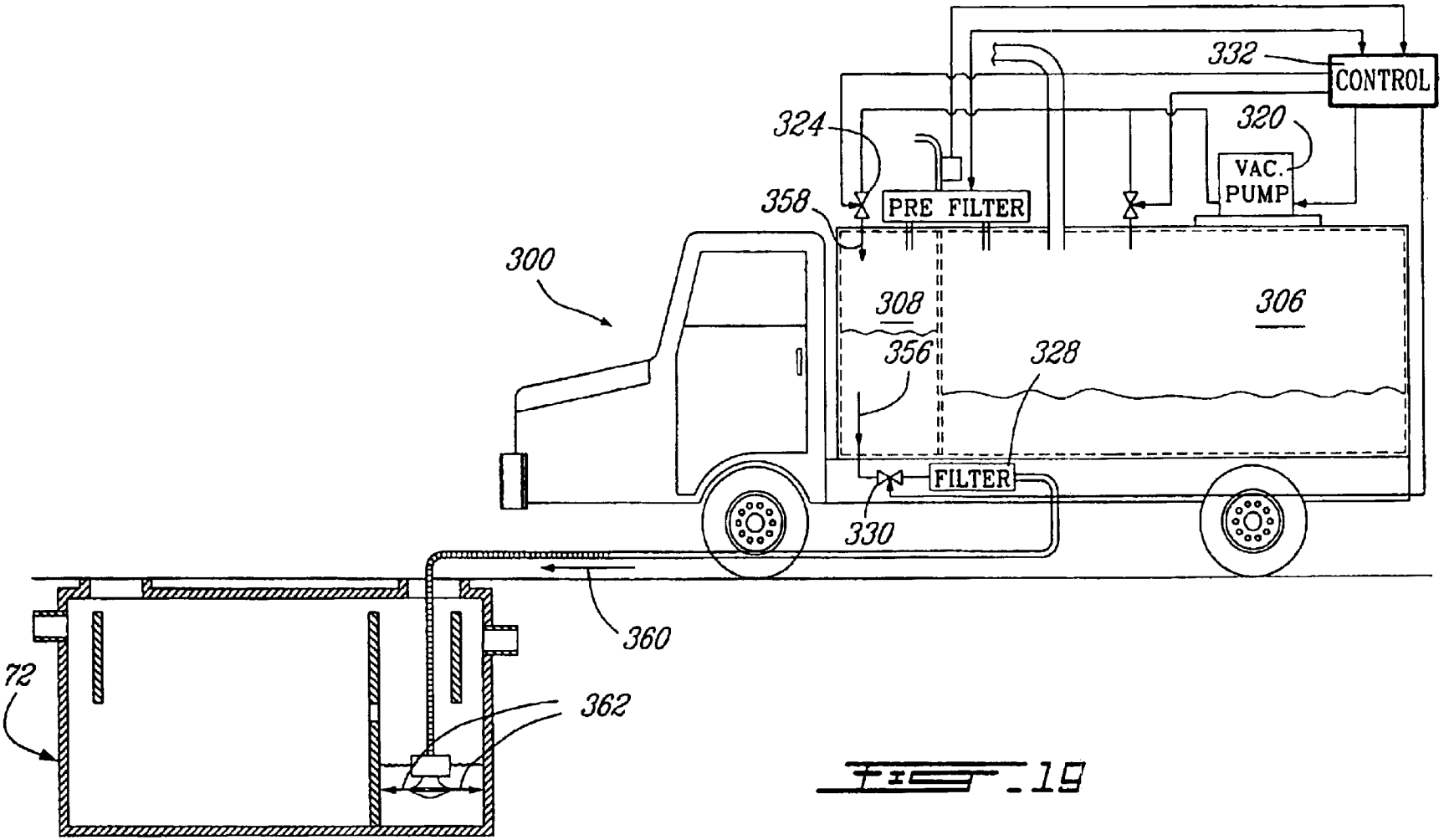
FIG. 19 is a schematic side elevational view of the mobile recuperation unit of FIG. 15, shown during the pumping back of the filtered supernatant to the downstream compartment of the septic tank.

Finally, FIG. 19 illustrates this supernatant transfer back to the tank 72 step from the supernatant reservoir 308 (see arrow 356). The controller 332 opens the valve 330 to allow a flow of supernatant therethrough. Optionally, the vacuum pump 320 may be energized to create a positive pressure (see arrow 358) in the reservoir 308 to thereby increase the speed of the supernatant transfer.

The supernatant goes through the filter 328 prior to its return to the tank 72 to remove the suspended matter contained therein. Again, the filtered suspended matter (not shown) is returned to the sludge reservoir 306 via a pipe (not shown). The filtered supernatant is thus returned to the tank 72 (see arrows 356, 360 and 362). Since the nozzle head 234 floats, the operator may take this pumping time to disassemble the pipe 312 to thereby reduce the total time required for the recuperation operation.

Again, as will easily be understood by one skilled in the art, the filter 328 may use different known technologies to remove the suspended matter in the supernatant. For example, bag filters, membrane filters, sand filters, cartridge filters, centrifugal filters or other appropriate type of filters could be used. Furthermore, other filtering technologies such as, for example, a clarifier could be used to remove the suspended matter in the supernatant.

As will readily be apparent to one skilled in the art, the various features of the three embodiments described hereinabove could be interchanged at will without departing from the spirit and nature of the present invention.

The method and system of the present innovation offers several advantages, such as:

- the recuperation of the supernatant from the top of the septic tank to the bottom thereof, to thereby reduce the turbidity of the recuperated supernatant;
- the return of filtered supernatant to the septic tank to thereby ensure the return of a clear liquid, relatively exempt of suspended solid particles;
- the system, by not being voluminous, facilitates the access to the septic tank;
- the system is easily operated;
- the system has a great operation autonomy before it becomes necessary for the unit to go to the dumping site, therefore reducing significantly transport, labour and dumping costs;
- by developing a mobile recuperation unit with low exploitation cost and high efficiency, it supplies the septic tank workers with the necessary tool to help them manage the sludge more efficiently while still reducing environmental impacts;
- the method does not require the use of chemical products; and
- the return of the filtered supernatant to the septic tank permits the regeneration of the septic tank's microflora, which is beneficial and generally encouraged by governmental authorities.

Although the present invention has been described hereinabove by way of preferred embodiments thereof, it can be modified, without departing from the spirit and nature of the subject invention as defined in the appended claims.

What is claimed is:

1. A method for the recuperation of septic tank content using a mobile recuperation unit having first and second reservoirs, the content of the septic tank including sludge, supernatant and scum, said method comprising:

- transferring a portion of the supernatant from the septic tank to the first reservoir of the mobile recuperation unit;
- transferring the remainder of the content of the septic tank into the second reservoir of the mobile recuperation unit;
- filtering the supernatant; and
- transferring the filtered supernatant from the first reservoir back to the septic tank.

2. The method for the recuperation of septic tank content as recited in claim 1, wherein said filtering step is done during the transfer of the supernatant from the septic tank to the first reservoir of the mobile recuperation unit.

3. The method for the recuperation of septic tank content as recited in claim 1, wherein said filtering step is done during the transfer of the supernatant from the first reservoir back to the septic tank.

4. The method for the recuperation of septic tank content as recited in claim 1, wherein said transferring step of the supernatant from the septic tank to the first reservoir of the mobile recuperation unit is done from the top, below the scum level, to the bottom, above the sludge level, of the septic tank.

5. The method for the recuperation of septic tank content as recited in claim 4, wherein said transferring step of the supernatant from the septic tank to the first reservoir of the mobile recuperation unit is done until the amount of suspended matter in the supernatant transferred exceeds a predetermined level.

6. The method for the recuperation of septic tank content as recited in claim 1, wherein said transfer steps are done by at least one pump.

7. The method for the recuperation of septic tank content as recited in claim 6, wherein said at least one pump includes a vacuum pump.

8. The method for the recuperation of septic tank content as recited in claim 1, wherein said filtering step is done using a filtering method selected from the group consisting of bag filtering, membrane filtering, sand filtering, cartridge filtering, centrifugal filtering and clarifying filtering.

9. The method for the recuperation of septic tank content as recited in claim 1, further comprising the step of prefiltering the supernatant during the transfer of the supernatant from the septic tank to the first reservoir.

10. A system for the recuperation of septic tank content including sludge, supernatant and scum, said system comprising:

- a first reservoir;
- a second reservoir;
- a bidirectional pump assembly having at least one pump suction pipe having a proximate end connected to a first port thereof; said pump assembly having a second port connected to said first reservoir and a third port connected to said second reservoir;
- a filtering assembly provided between said second port and said first reservoir;
- and control means whereby, said bidirectional pump assembly pumps the supernatant from the septic tank into said first reservoir, filters this supernatant via said filtering assembly, pumps the sludge and the scum to said second reservoir and pumps back the filtered supernatant to the septic tank to thereby reduce the portion of the content of the septic tank remaining in the recuperation system.

11. The system for the recuperation of septic tank content recited in claim 10, wherein said bidirectional pump assembly further includes a fourth port connected to the bottom of said first reservoir.

12. The system for the recuperation of septic tank content recited in claim 10, wherein said filtering assembly includes a filter selected from the group consisting of bag filters, membrane filters, sand filters, cartridge filters, centrifugal filters and clarifier filters.

13. The system for the recuperation of septic tank content recited in claim 12, wherein said filter is a membrane filter and includes a continuous biodegradable filtering medium; said recuperation system further comprising a shredder used to shred used portions of said biodegradable filtering medium and to place the shredded medium in said second reservoir.

14. The system for the recuperation of septic tank content recited in claim 10, wherein one of said at least one pump suction pipe has a distal end provided with a nozzle head having lateral apertures.

15. The system for the recuperation of septic tank content recited in claim 14, wherein said nozzle head further includes a generally conical shaped end.

16. The system for the recuperation of septic tank content recited in claim 10, further comprising a controller electrically connected to said bidirectional pump assembly and to said filtering assembly; said controller being configured to control the operation of these assemblies.

17. The system for the recuperation of septic tank content recited in claim 10, wherein said filtering assembly includes pre-filter.

18. A system for the recuperation of septic tank content including sludge, supernatant and scum, said system comprising:

a first reservoir;

a first pump having an inlet and an outlet open to said first reservoir;

a first pump suction pipe having a proximate end connected to said inlet of said first pump;

a filtering assembly associated with said first pump suction pipe;

a second reservoir;

a second pump having an inlet and an outlet open to said second reservoir;

a second pump suction pipe having a proximate end connected to said inlet of said second pump;

and control means whereby, a) said first pump pumps the supernatant from the septic tank to said first reservoir, b) said filtering assembly filters the pumped supernatant, c) said second pump pumps the sludge and the scum to said second reservoir, and d) said first pump pumps back the filtered supernatant to the septic tank to thereby reduce the portion of the content of the septic tank remaining in the recuperation system.

19. The system for the recuperation of septic tank content recited in claim 18, further comprising a controller electrically connected to said first and second pumps and to said filtering assembly; said controller being configure to control the operation thereof.

20. The system for the recuperation of septic tank content recited in claim 19, further comprising a sensor associated with said first pump suction pipe and connected to said controller to supply information about the turbidity of the pumped supernatant.

21. The system for the recuperation of septic tank content recited in claim 20, further comprising a bypass assembly controlled by said controller, said bypass assembly being so associated to said first pump suction pipe as to divert the flow thereof from said first reservoir to said second reservoir upon detection of a turbidity level above a predetermined level.

22. The system for the recuperation of septic tank content recited in claim 18, wherein said filtering assembly includes a filter selected from the group consisting of bag filters, membrane filters, sand filters, cartridge filters, centrifugal filters and clarifier filter.

23. The system for the recuperation of septic tank content recited in claim 22, wherein said filtering assembly further includes a pre-filter.

24. The system for the recuperation of septic tank content recited in claim 18, wherein said first pump suction pipe has a distal end provided with a nozzle head having lateral apertures.

25. The system for the recuperation of septic tank content recited in claim 24, wherein said nozzle head further includes a generally conical shaped end.

26. The system for the recuperation of septic tank content as recited in claim 24, wherein said nozzle head further includes a floating element configured and sized to keep said lateral apertures below the level of the scum.

27. A method for the recuperation of tank content using a mobile recuperation unit having first and second reservoirs, the content of the tank including sludge, supernatant and scum, said method comprising:

transferring a portion of the supernatant from the tank to the first reservoir of the mobile recuperation unit;

transferring the remainder of the content of the tank into the second reservoir of the mobile recuperation unit;

filtering the supernatant; and transferring the filtered supernatant from the first reservoir back to the tank.

28. A system for the recuperation of tank content including sludge, supernatant and scum, said system comprising:

a first reservoir;

a second reservoir;

a bidirectional pump assembly having at least one pump suction pipe having a proximate end connected to a first port thereof; said pump assembly having a second port connected to said first reservoir and a third port connected to said second reservoir;

a filtering assembly provided between said second port and said first reservoir;

and control means whereby, said bidirectional pump assembly pumps the supernatant from the septic tank into said first reservoir, filters this supernatant via said filtering assembly, pumps the sludge and the scum to said second reservoir and pumps back the filtered supernatant to the tank to thereby reduce the portion of the content of the tank remaining in the recuperation system.

29. A system for the recuperation of tank content including sludge, supernatant and scum, said system comprising:

a first reservoir;

a first pump having an inlet and an outlet open to said first reservoir;

a first pump suction pipe having a proximate end connected to said inlet of said first pump;

a filtering assembly associated with said first pump suction pipe;

a second reservoir;

a second pump having an inlet and an outlet open to said second reservoir;

a second pump suction pipe having a proximate end connected to said inlet of said second pump;

and control means whereby, a) said first pump pumps the supernatant from the tank to said first reservoir, b) said filtering assembly filters the pumped supernatant, c) said second pump pumps the sludge and the scum to said second reservoir, and d) said first pump pumps back the filtered supernatant to the tank to thereby reduce the portion of the content of the tank remaining in the recuperation system.

* * * * *